United States Patent [19]

Badone et al.

[11] 3,977,460

[45] Aug. 31, 1976

[54] APPARATUS FOR CONTROLLING THE POUR RATE OF A LADLE

[75] Inventors: Louis Badone, Willowdale; Frederick W. A. Baulch, Islington; William J. Bridges, Toronto; Robert J. Fulton, Mississauga; Jeremy N. Marr, Islington; Ralph H. Mechem, Mississauga; Joseph W. Valler, Downsview; George G. Wellington, Oakville, all of Canada

[73] Assignee: Chrysler Corporation, Highland Park, Mich.

[22] Filed: Oct. 12, 1971

[21] Appl. No.: 188,056

[52] U.S. Cl. ..... 164/155; 222/166; 164/129; 164/337

[51] Int. Cl.[2] ..... B22D 37/00

[58] Field of Search ..... 222/166, 164, DIG. 8, 222/DIG. 15, DIG. 9; 164/336, 155, 337, 129

[56] References Cited

UNITED STATES PATENTS

| | | | |
|---|---|---|---|
| 1,958,846 | 5/1934 | Christensen | 222/166 X |
| 2,611,939 | 9/1952 | Kux | 164/336 X |
| 3,393,837 | 7/1968 | Takeshima | 222/166 |

FOREIGN PATENTS OR APPLICATIONS

| | | | |
|---|---|---|---|
| 455,300 | 5/1913 | France | 222/166 |
| 245,144 | 3/1912 | Germany | 222/DIG. 8 |
| 260,840 | 5/1965 | U.S.S.R. | 222/DIG. 9 |

*Primary Examiner*—Robert B. Reeves
*Assistant Examiner*—David A. Scherbel
*Attorney, Agent, or Firm*—Talburtt & Baldwin

[57] ABSTRACT

An automated ladle, based on a swinging arm concept, for pouring piston castings automatically. The ladle is tilted to a pour position by means of a motor driven cam which twists the swinging arm about its longitudinal axis, the ladle being carried at the end of the arm. Electrical circuitry interconnects the ladle mechanism with a molten metal holding furnace and a pair of automated piston molding machines for automatically controlling the operation of the entire assembly.

15 Claims, 28 Drawing Figures

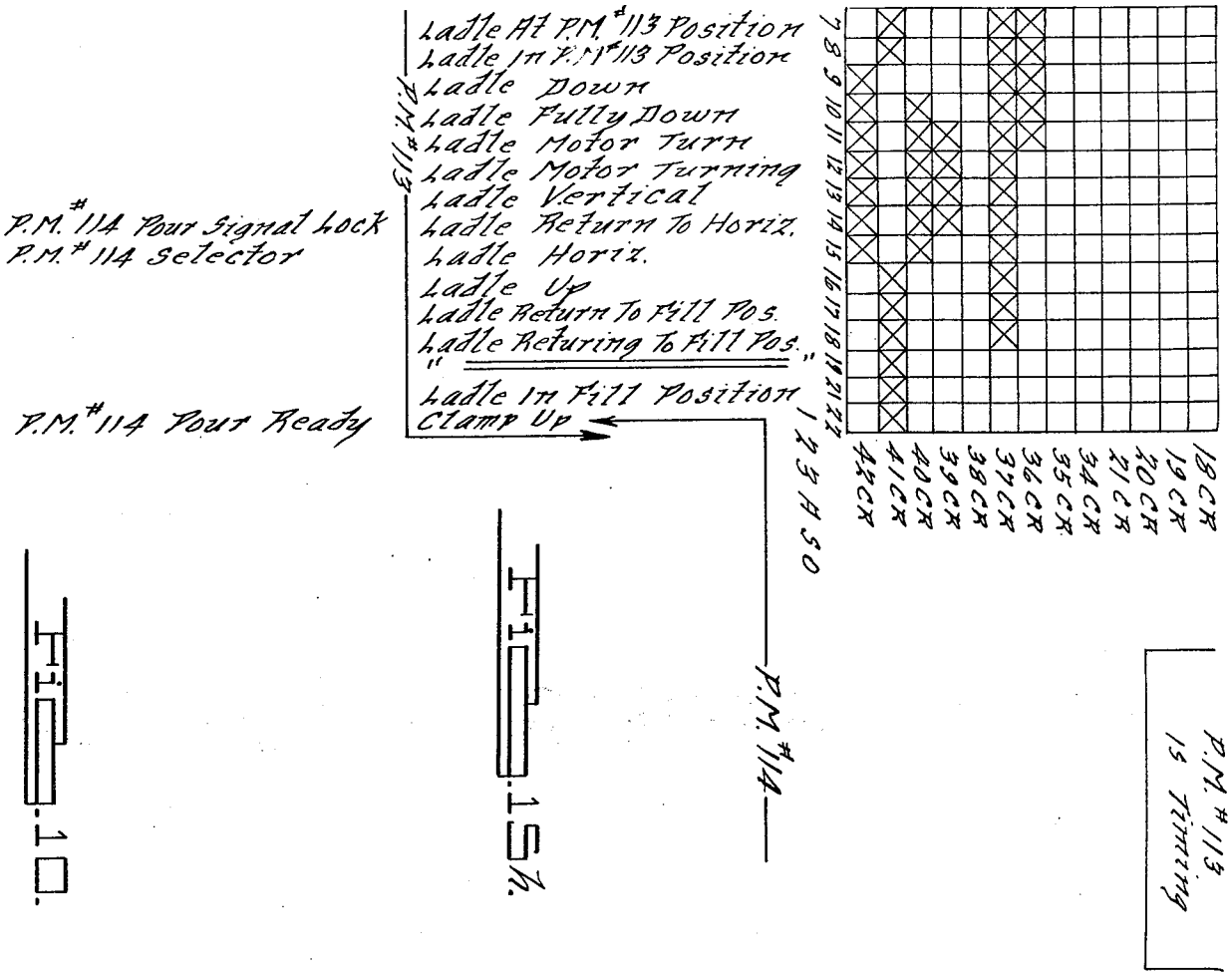
FIG. 15h.
FIG. 10.
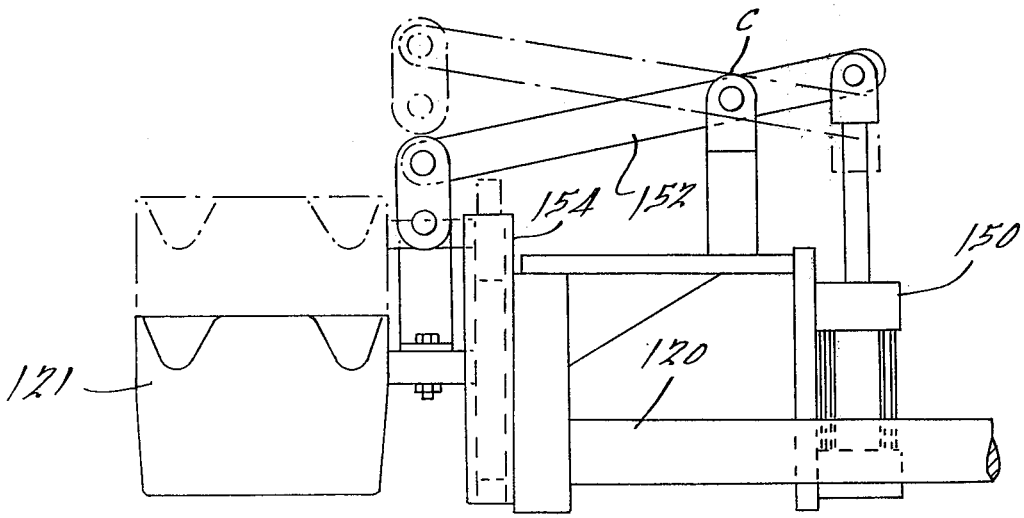

Lindberg Auto Ladle Panel
Auto Ladle Pour Lockout
Contact Closes On Completion Of Pour
Hand Dump ON OFF
Clamp Up
Ladle Swing C.W.
Delayed Open
Delayed Close
Ladle Swing C.C.W.
P.M. #113 To Fill
P.M. #113 To Dump
Fill To P.M. #114
Fill To P.M. #113
P.M. #114 To Fill
To Fig. 12D

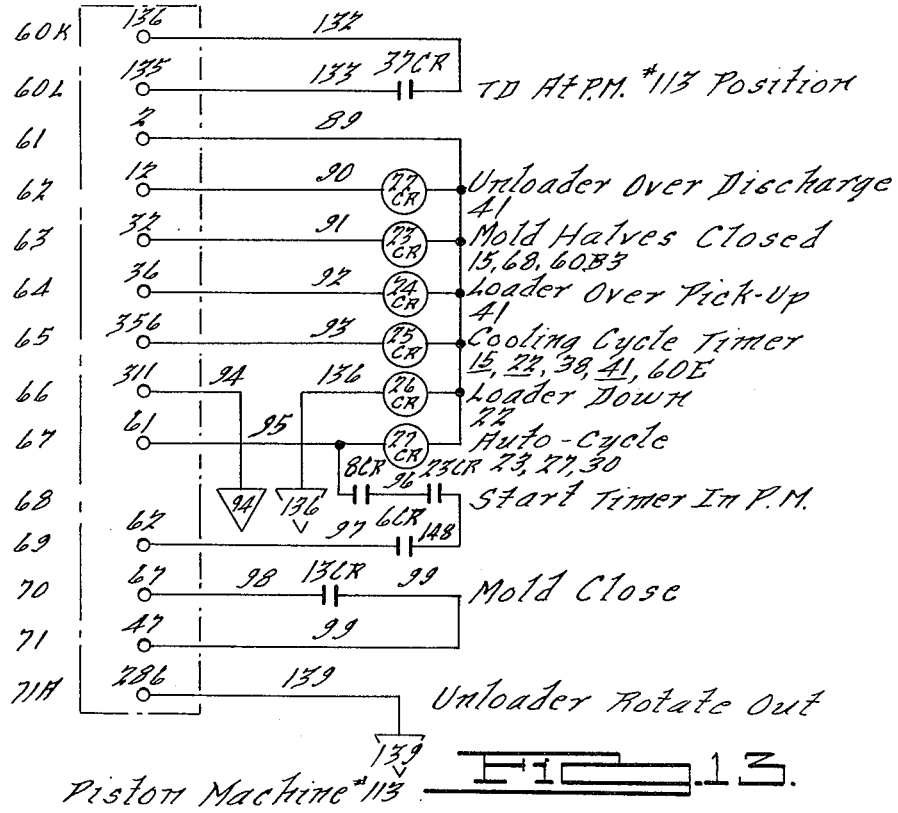
FIG. 13.
FIG. 14.
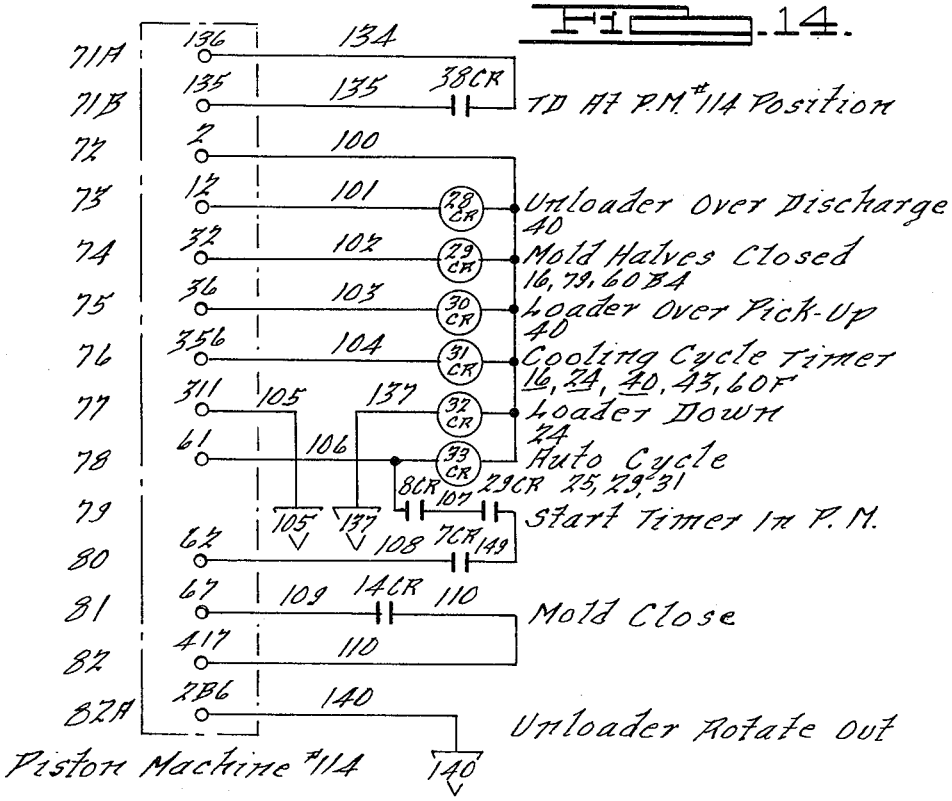

Fig. 15a.

| | | | Restor Start Pos. | 1 | 2 |
|---|---|---|---|---|---|
| P.M. #113 | Incoming Signals | Unloader Over Discharge | 22CR | X | X | X |
| | | Mold Halves Closed | 23CR | | | |
| | | Loader Over Pick Up | 24CR | X | | |
| | | Cooling Cycle Timer | 25CR | | | |
| | | Loader Down | 26CR | | X | X |
| | | Auto Cycle | 27CR | X | X | X |
| | Outgoing Signals | Ladle At #113 Position | | | | |
| | | Start Timer In P.M. | | | | |
| | | Mold Close | | | | |
| P.M. #114 | Incoming Signals | Unloader Over Discharge | 28CR | O | O | O |
| | | Mold Halves Closed | 29CR | | | |
| | | Loader Over Pick Up | 30CR | O | O | O |
| | | Cooling Cycle Timer | 31CR | | | |
| | | Loader Down | 32CR | | | |
| | | Auto Cycle | 33CR | O | O | O |
| | Outgoing Signals | Ladle At #113 Position | | | | |
| | | Start Timer In P.M. | | | | |
| | | Mold Close | | | | |
| Actions | | Ladle In Fill Position | 1LS | X | X | X |
| | | Clamp Up | 2ALS | X | X | X |
| | | Clamp Down | 2BLS | | | |
| | | Ladle Horizontal | 3LS | X | X | X |
| | | Ladle In P.M. #113 Position | 4LS | | | |
| | | Ladle In P.M. #114 Position | 5LS | | | |
| | | Ladle Vertical | 6LS | | | |
| | | Ladle In Dump Position | 7LS | | | |
| | | Ladle At P.M. #113 Position | 8LS | | | |
| | | Ladle At P.M. #114 Position | 9LS | | | |
| | | Ladle Down | 11ALS | | | |

Fig. 15b.

| | | | | | |
|---|---|---|---|---|---|
| On Pouring Ladle | Ladle Down | | 11ALS | X | |
| | Ladle Up | | 11BLS | X | |
| | Ladle Move From Fill Position To P.M. #113 Position | C.C.W.-Sol. | | | |
| | " " P.M. #114 Position To Fill Position | | | | |
| | " " P.M. #114 Position To Dump Position | | | | |
| | " " Fill Position To P.M. #114 Position | C.W.-Sol. | | | |
| | " " P.M. #113 Position To Fill Position | | | | |
| | " " P.M. #113 Position To Dump Position | | | | |
| | " " Fill Position To Dump Position | | | | |
| Autoladle | Clamp Up Sol. | | Sol. | X | |
| | Ladle Up Sol. | | Sol. | X | |
| | Ladle Down Sol. | | Sol. | | |
| | Fast Approach Sol. | | Sol. | | |
| | Ladle Motor Turn | | | | |
| | Pour Metal | | | | |
| | Abort Timer On | | Ladle 1 | | |
| | Ladle Timer On | | Ladle 2 | | |
| | Fast Speed Timer On | | Ladle 3 | | |
| Out Going To Lindberg Autoladle | Pour Metal | | | | 1% |
| Ladle Apparatus Signals | Master Control | | 1CR | | |
| | Fill Position | | 2CR | X | |
| | Clamp Up | | 3CR | X | |
| | Clamp Down | | 4CR | | |
| | Ladle Horizontal | | 5CR | X | |
| | Ladle In P.M. #113 Position | | 6CR | | |
| | Ladle In P.M. #114 Position | | 7CR | | |
| | Ladle Vertical | | 8CR | | |
| | Ladle In Dump Position On Failure | | 9CR | | |
| | Ladle Return To Horizontal Position | | 10CR | | |
| | P.M. #113 Pour Signal Lock In | | 11CR | | X |
| | P.M. #114 Pour Signal Lock In | | 12CR | | |
| | P.M. #113 Selector | | 13CR | | |
| | P.M. #114 Selector | | 14CR | | |
| | Pour Signal | | 15CR | | |
| Incoming From Lindberg Autoladle | Autoladle Pour Lock Out | | 16CR | | |
| | Failure | | 17CR | | |
| | Dump Position Lock Out | | 18CR | | |

Dump Position Lock Out
Dump Clock Wise
Dump To Fill Counter Clock Wise
Dump To Fill Lock In
Hand Dump
Ladle In Dump Position On Hand Dump
Autoladle Pour Lock Out
Ladle At P.M. #113 Position
Ladle At P.M. #114 Position
Ladle Motor Drive On
Ladle Down
Ladle Up
Ladle Down

Fig. 15f.

APPARATUS FOR CONTROLLING THE POUR RATE OF A LADLE

BACKGROUND OF THE INVENTION

This invention relates generally to apparatus for the automatic or automated casting of articles. The invention can be used in casting or pouring a wide variety of items both as to type and as to material. An exemplary application of the invention is in the casting of pistons for internal combustion engines. A primary object of the invention is to provide reliable automated pouring ladle equipment having improved simplified construction and operation over prior pouring approaches. Another object of the invention is to provide the necessary interfacing or interlocking control means for use with known automated equipment such as metal holding furnaces and automatic molding machines. It is also an object of this invention to provide automated pouring equipment which is compatible with current space requirements for most production piston molding facilities.

Most of the pistons cast in the automotive industry today are cast manually. This fact may be surprising in this age of automation. However, it is a fact that the industry has been unable to obtain automated equipment capable of pouring molten metal as well as it can be poured manually. Certain problems exist in the manual pouring of pistons which make automated pouring means desirable.

The quality of productivity of permanent mold pistons produced by manual pouring is controlled to a major extent by human elements. This fact is obvious to those familiar with this art since they know that there are differences in quality and productivity between pourers even though extensive mechanical factors have been provided to assist the pourer in his task.

In general, various expedients have been used at one time or another in order to attempt to obtain low scrap and high production rates such as, temperature and metallurgical control of the metal; closely timed cooling cycle of the poured metal; closely controlled mold dimensions; temperature and flow rate control of the mold cooling system and water, and scale formation prevention in the water cooling system for the mold. All of these expedients are based on the belief that metal of the same composition, poured at the same temperature, and in the same manner, into molds of the same shape and under the same cooling conditions, will produce the same finished product each time. Furthermore, if these conditions are correctly set, it is believed that the quality of the product will be uniformly high and more satisfactory for use.

In spite of all of the controls of the type listed above which have been used, scrap still occurs erratically and on a continuing basis. The majority of this scrap can be traced to one factor which is completely variable, that is the man pouring the metal. Well trained and conscientious operators can produce a good product with very little scrap attributable to pouring per se. However, the job is hot and arduous and a relatively high labor turn-over exists. New men in training and other human factors tend to produce scrap and low productivity.

The major operator attributable scrap causes are: mis-runs, flash, trapped gas and inclusions.

Mis-runs are caused by metal not running into areas of the mold which it should fill. This can occur because metal traveling to the area in question freezes before that particular mold cavity area can be completely filled with molten metal.

Three main human factors appear to be active in this regard. The transfer of metal from the furnace to the mold slowly causes the operator to start his pour with colder metal than a faster transferring operator. Pouring the transferred metal at slow rates delivers cooler metal into the mold cavity areas than pouring at faster rates. Pouring fewer pistons per hour causes operation with cooler molds than producing at a faster rate.

Flash is the reverse of mis-runs. It is caused by metal running into mold joints where it is not desired and where it forms thin pieces of excess metal. It is less common as an operator fault than mis-runs since the main human factors which produce it are less frequently encountered.

Again, three primary human factors appear to be operative in causing flash. Fast transfer from the furnace to the mold results in hotter metal than is necessary for a good cast article. Faster pouring rates provide hotter metal with greater kinetic energy in the joint areas. Faster production rates result in hotter molds.

Entrapped gas results when metal is poured into a mold in an erratic or turbulent manner so that air is trapped in the entering stream of molten metal causing the formation of large voids in the casting. The gas entrapped in the molten metal stream does not break out from the molten metal at a mold/metal surface for two main reasons. Firstly, the inside of the void becomes oxidized as soon as the air is entrapped and metal outside acts as an envelope to contain the gas. Secondly, the solidification is very rapid in the mold and the metal freezes before the entrapped gas can break out of the surface.

Inclusions of metal oxide, refractory particles and the like usually occur when an operator does not skim back the surface of the metal in the furnace before dipping to fill the ladle or when he uses a dirty ladle which contains metal oxide in the form of a skin which lines the ladle from the last pour.

From the above it can be seen that a mechanical, preferably automatic, means for transferring metal from a molten metal holding furnace or the like to a mold should be expected to provide a considerable increase in quality and productivity. However, such a means must overcome the problems associated with molten metal as discussed hereinabove. Attempts to mechanize the pouring process have been previously made. However, no successful production methods or apparatus for automatic pouring, particularly of pistons, has attained actual industrial use insofar as is presently known. At present, all known major permanent mold piston producers continue to hand pour the metal into the molds when manufacturing pistons.

Experience indicates that the following requirements are absolutely necessary for a successful mechanical pouring apparatus. The machine must be rugged. Smooth action is imperative. The action must be fast but well controlled. There should be buffering at the end machine movements i.e., there should be no abrupt starting or stopping which tends to wash metal about in the ladle or spill it. The action must be positive in that its movements are repeatable and all carried out in the same place.

The following observations have been made in connection with the best hand pourers of pistons. These pourers do not rotate the ladle about its approximate center of gravity but rotate it about a horizontal axis across or normal to the tip of the ladle pouring spout. To start the pour the spout is placed as close into the sprue opening of the mold as possible to minimize the free fall into the mold and the turbulence generated during the pour. A good operator pours rapidly at the immediate start of the pour then appears to reduce the rate of metal delivery somewhat until close to the end of the pour when metal appears at the base of the riser. At this point he tends to raise the ladle somewhat and increase the rate of pour until the riser is full when he cuts off the flow of metal completely.

It is speculated that the fast start with a minimum free fall is necessary to establish fast filling of the lower parts of the mold at a time when these portions of the mold are at their coldest in the casting cycle. Fast pouring at this stage ensures that metal reaches the remote cold parts of the mold. Once flow has been established it is desirable to slow down the rate of pour so that metal fills the mold layer upon layer with the hottest metal always being the highest layer in the mold. Thus, feeding the cooler areas of the mold, which are solidifying and contracting, is available from the hot metal in the higher areas. The end of this stage of the pouring operation occurs when the cavity has been filled completely and the next task is to fill the riser of the mold. The function of the riser is to act as a reservoir of molten metal to be drawn into the cooler areas of the mold as the metal solidifies and to compensate for the solidification shrinkage which takes place. It is thus an ideal situation that the riser be filled with the hottest metal possible. By increasing the rate of flow from the ladle and sometimes even raising the spout slightly the metal runs into the sprue more quickly and with a higher kinetic energy. This combination ensures that the last metal poured moves rapidly through the sprue and into the riser to give the hottest possible metal in the riser area.

SUMMARY OF THE INVENTION

The apparatus of this invention comprises a swinging arm having a ladle mounted on the end thereof. A cam, turned by a motor, is arranged in combination with a cam follower, to rotate the arm about its longitudinal axis upon rotation of the cam thereby tilting the ladle to pour molten metal therefrom. The cam is shaped, according to circumstances, to provide a programmed pour suitable to the particular mold. Accordingly, the slope of the cam may cause fast pouring at one point in the pour and slow pouring at another, as desired.

In an automated form, with such an apparatus in a "start" position, the ladle is located under the pouring spout of a molten metal holding and dispensing means and is filled with a measured or metered amount of molten metal. The dispensing means provides a signal that the metered amount of molten metal has been placed in the ladle and a mold apparatus, such as an automatic piston molding machine, provides a signal that is ready to receive the molten metal into the mold. Upon receipt of these signals the swinging arm swings the ladle into its pouring position above the mold. The arm may be swung by any suitable rotary mechanism preferably of an electrical or hydraulic type. Also preferably, a "stop" means will be arranged so that arm may rest against it when the ladle is positioned in the pouring position above the mold. In contacting the stop a limit switch issues a signal that the arm and ladle have reached the "pouring" position. A second signal is preferably necessary before pouring the molten metal from the ladle. This is a signal from the molding machine that the molds are completely ready to receive molten metal. On receipt of these signals the pouring mechanism is actuated to rotate the swinging arm about its longitudinal axis by rotation of the cam and contact against the cam follower thus tilting the ladle and pouring the molten metal into the mold. A limit switch is set to sense when the ladle has reached the position where all the metal has been poured. At this point the swinging arm starts its return to the "fill" position while the ladle tilting mechanism continues to run and returns the ladle to its horizontal "fill" position. Upon reaching the "fill" position the swinging arm closes the limit switch stopping its own movement and preferably brings a mechanical lock, such as a clamp, into a position fixing the arm in a positive location while the ladle is in the "fill" position. The ladle remains in this position until the signal is obtained from the mold or from a second mold that the casting has been removed therefrom and pouring can again be commenced. At this point the cycle is initiated again. An abort means is preferably included in case the mold cannot for some reason receive the molten metal. In such a situation the ladle is moved to a position where the metal is poured into an ingot mold or the like.

BRIEF DESCRIPTION OF THE DRAWINGS

FIG. 10 is a schematic representation of a ladle dropping mechanism which may be incorporated onto the end of the swinging arm in order to adjust the height of the automatic pouring ladle relative to the mold into which the molten metal is to be poured.

FIG. 12, made up of portions 12*a*, 12*b*, 12*c*, 12*d* and 12*e*, is a ladder-like electrical schematic showing the arrangement of the various limit switches illustrated in FIGS. 5 through 9 and the various control relays and other electrical components which control the automated function of the automatic pouring ladle. FIG. 12*b* is a continuation of the circuit shown in FIG. 12*a* and connects thereto at common points *a; * FIG. 12*e* is a continuation of FIG. 12*d* and connects thereto at common points *d*, and common point E of FIG. 12*c* connects to E of FIG. 12*e*.

FIGS. 13 and 14 are fragmentary electrical schematics showing the electrical terminal portions of two piston molding machines placed to either side of the automatic pouring ladle apparatus and also showing the various control relays which interconnect the piston molding machines to the automatic pouring ladle for the automated control of the entire molding operation from the filling of the pouring ladle to the pouring of the molten metal into the molds and the unloading of the cast pistons therefrom by the automatic piston molding machines.

DESCRIPTION OF THE PREFERRED EMBODIMENTS

Figure 1:
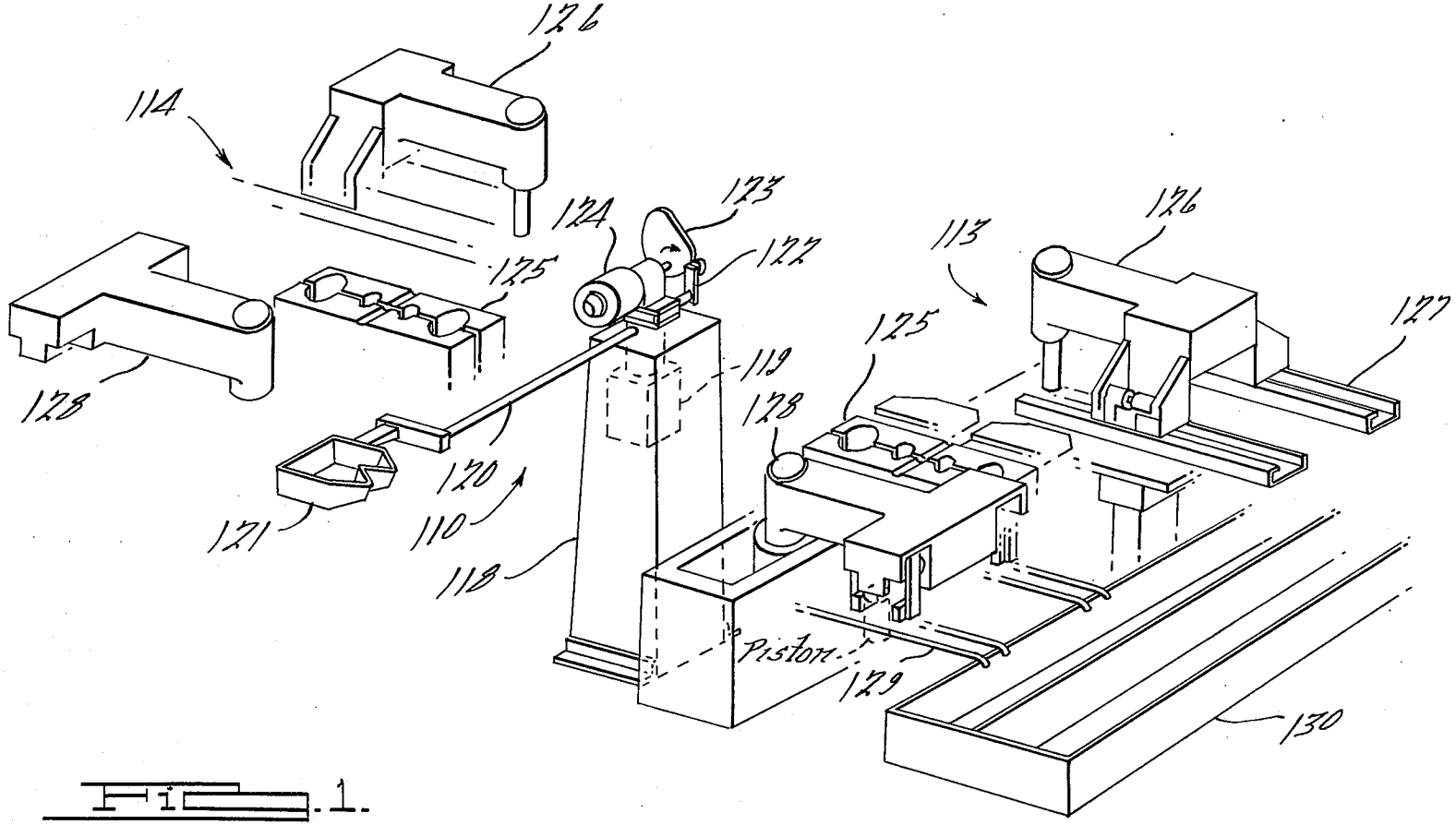
FIG. 1 is a pictorial schematic illustrating the basic mechanical components of a ladle pouring apparatus according to the invention and its position relative to a pair of piston molding machines of an automatic type.
Figure 2:
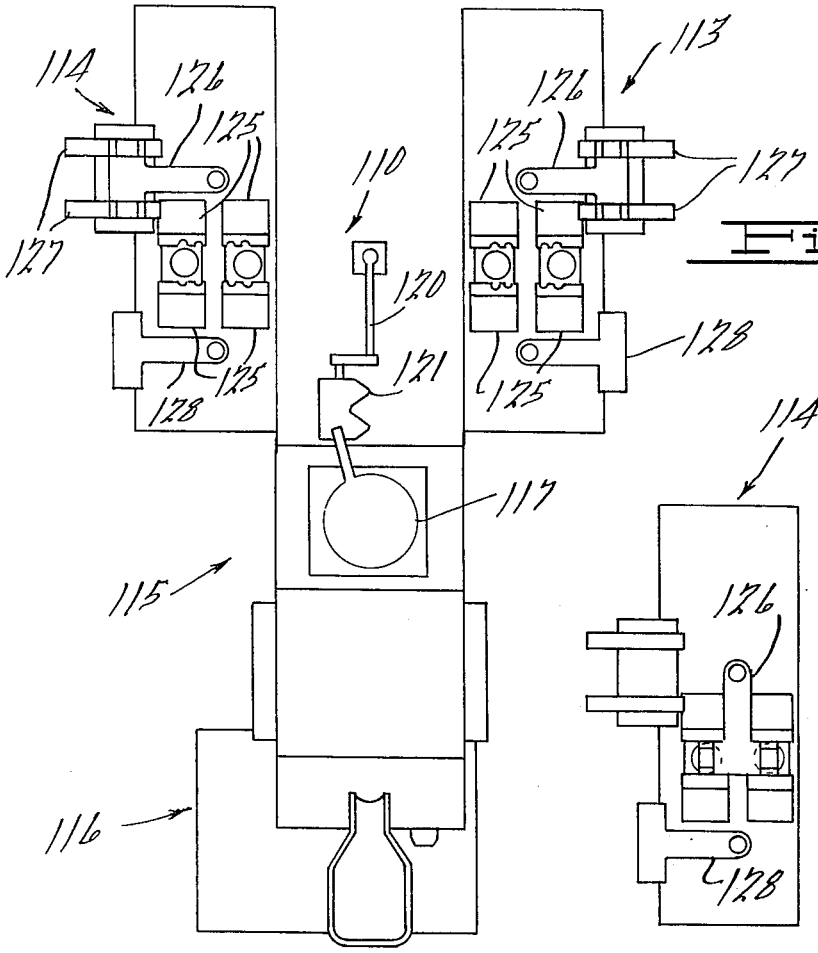
FIG. 2 is a schematic plan view of an apparatus according to the invention showing its general arrangement relative to a pair of automatic piston molding machines and a metal holding furnace, the automatic pouring ladle being shown in the "fill" position.

Shown in the drawings, FIGS. 1 through 4 in particular, is a piston casting installation comprised of an automatic piston pouring ladle apparatus or transfer device according to the invention, generally designated at 110, which is positioned between a pair of automatic piston molding machines generally designated at 113 and 114, respectively. The molding machines per se do not form any part of this invention and may be of the type disclosed in U.S. Pat. No. 2,965,938 which issued on Dec. 27, 1960. These machines are shown for illustrative purposes and only so much of them as is necessary will be described herein in connection with the present invention. It will be apparent to those familiar with this art that other kinds of molds may be used in their place. An electrically controlled automatic version of the molding machines described in the above-mentioned patent is commercially available and will be briefly described in connection with the automatic pouring ladle apparatus of the present invention as illustrative of a completely automatic piston casting installation. The other basic component of the casting installation is shown in FIG. 2 at 115 and consists of a molten metal holding means indicated by 116 and a dispensing or metering means 117 for metering measured amounts of molten metal into the automatic pouring ladle apparatus 110. Metering means 117 may, for example, take the form of a device known as an AUTOLADLE which is marketed by the Lindberg-Hevi-Duty Division of Sola Basic Industries of Watertown, Wis. Such a unit consists essentially of a self-contained crucible assembly which is immersed in a suitable sized furnace chamber filled with molten metal. A refractory delivery tube is connected to the bottom of the special crucible and extends to the outer furnace shell above the furnace metal level. Since the crucible and delivery tube are submerged within the molten metal, the temperature of the liquid metal within the crucible and delivery tube is constantly maintained at proper temperature by the molten metal itself. Automatic valving may be arranged for dispensing molten metal by controlling the flow of molten metal through the delivery tube to the automatic pouring ladle apparatus 110. Thus unit is disclosed more specifically in U.S. Pat. No. 2,846,740 and does not form a part of the present invention per se. Therefore, only so much of it as is necessary is described herein and further details concerning it may be obtained from the referenced patent.

The automatic ladle pouring apparatus 110 comprises a base 118 which carries a rotary unit 119 for rotating a swinging arm 120 and its accompanying mechanism. Rotary unit 119 may be, for example, the Rotac Model RN-34-IV made by the Ex-Cell-O Corporation and may be of a hydraulic or electrically actuated type. The Rotac unit is actuated to swing arm 120 from the position shown in FIGS. 1 and 2, the "fill" position, to either of the piston machines 113 or 114 in a rotary motion. In order to tilt ladle 121, which is positioned at the end of swinging arm 120, the opposite end of swinging arm 120 is fitted with a cam roller follower 122 and a suitably positioned cam 123 which is driven by an electric motor 124. When motor 124 is activated, cam 123 is rotated in the direction of the arrow causing follower 122 to rotate swinging arm 120 about its longitudinal axis thus tilting ladle 121 to accomplish pouring. As will be described in detail hereinbelow, these actions form the part of a piston casting cycle which is accomplished automatically in conjunction with the operation of the piston molding machines and the metering of molten metal into ladle 121 from the metal holding unit 115.

As can be seen from FIG. 1, cam 123 may be shaped to provide any desired pouring rate at ladle 121 by controlling the shape of the cam. For example, in accordance with studies in conjunction with the present invention and as indicated hereinabove, it was determined that variable pouring rates are desirable in pouring pistons for automobile engines and that the pouring rate should be initially fast with a gradual decrease in flow from the ladle during the pour. This may be readily accomplished by providing a cam which is generally oblong as shown in FIG. 1 to thereby rotate follower 122 rapidly during initial movement of the cam and more slowly during the later portion of the cam movement. It has also been determined that this specific mechanical arrangement for accomplishing tilting of the ladle by rotating the swinging arm about its longitudinal axis in response to the rotation of a cam and cam follower arrangement as shown makes possible the smooth pouring at variable pour rates which is so necessary and critical to the successful automated pouring of molten metal to closely simulate the pouring motions of manual operators.

Each of the piston casting machines 113 and 114 include two centrally disposed substantially identical sets of sectional molds 125 (shown in the closed position) which may be opened and closed by suitable hydraulically actuated means (not shown) which move the mold sections toward and away from each other for assembling the components to form a mold cavity and for dis-assembling the components to expose an article which has been cast in the cavity. Supported at one side of molds 125 is a strut loader 126 (shown in the out and up position) which can be raised, lowered and rotated for transferring reinforcing elements or struts from a strut magazine 127 to molds 125 so that the reinforcing struts may be embedded in the piston which is to be cast in the mold cavity. The function of the strut is to control the thermal expansion of the piston in the automobile engine. Supported on the other side of molds 125 is a piston unloader 128 (shown in the out and down positions) which can be raised, lowered and rotated for engaging pistons cast in the molds and carrying them to a cooling location such as a rack 129 at one side of the machine from which the piston may be moved to a conveyor belt such as that indicated at 130.

FIG. 2 illustrates ladle 121 in the "fill" position and the piston molds 125 on the two piston machines 113 and 114 in the "open" and "ready" condition, that is, ready to receive a charge of molten metal from ladle 121. With ladle 121 in the "fill" position, a measured or metered amount of molten metal is released from unit 117 into the ladle.

Figure 3:
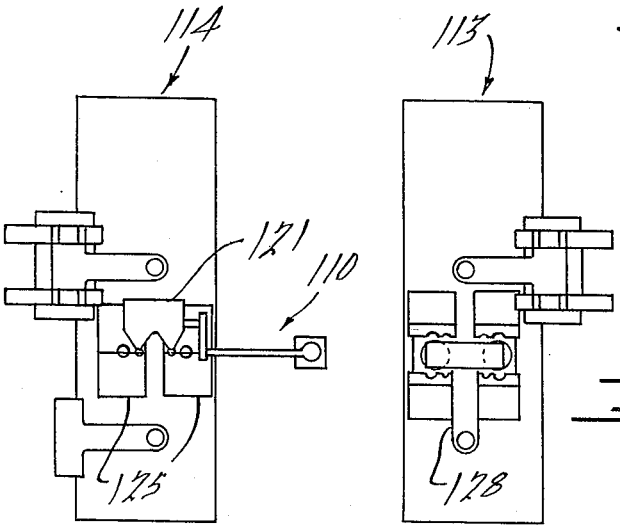

FIG. 3 shows ladle 121, containing metal, moved into a pouring position over piston machine 114; the molds are closed and ready to receive a charge of molten metal. Unloader arm 128 on piston machine 113 is shown in the act of removing castings from the open molds of that machine.

Figure 4:
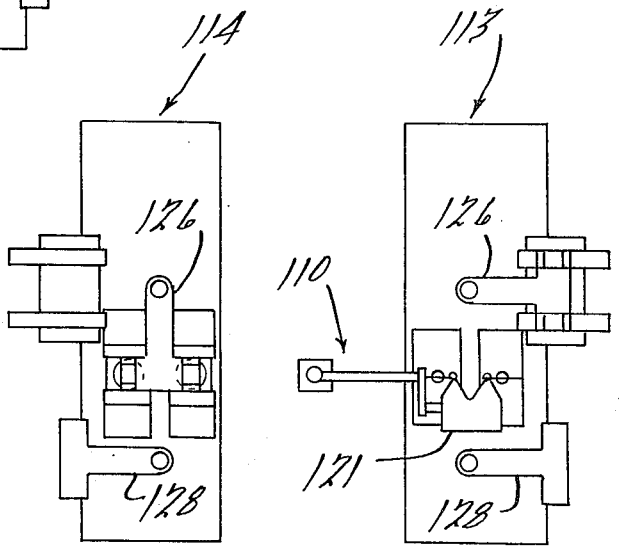
FIGS. 3 and 4 are generally similar schematic plan views showing the automatic pouring ladle in the "pouring" position at each of the automatic molding machines.

In FIG. 4 ladle 121 has poured molds on machine 114, moved back to the "fill" position as illustrated in FIG. 2 and has moved to the "pour" position on machine 113. Struts are shown being placed in the mold of machine 114 and the castings which were poured in FIG. 3 are now on unloader arm 128 and in the "discharge" position.

Figure 5:
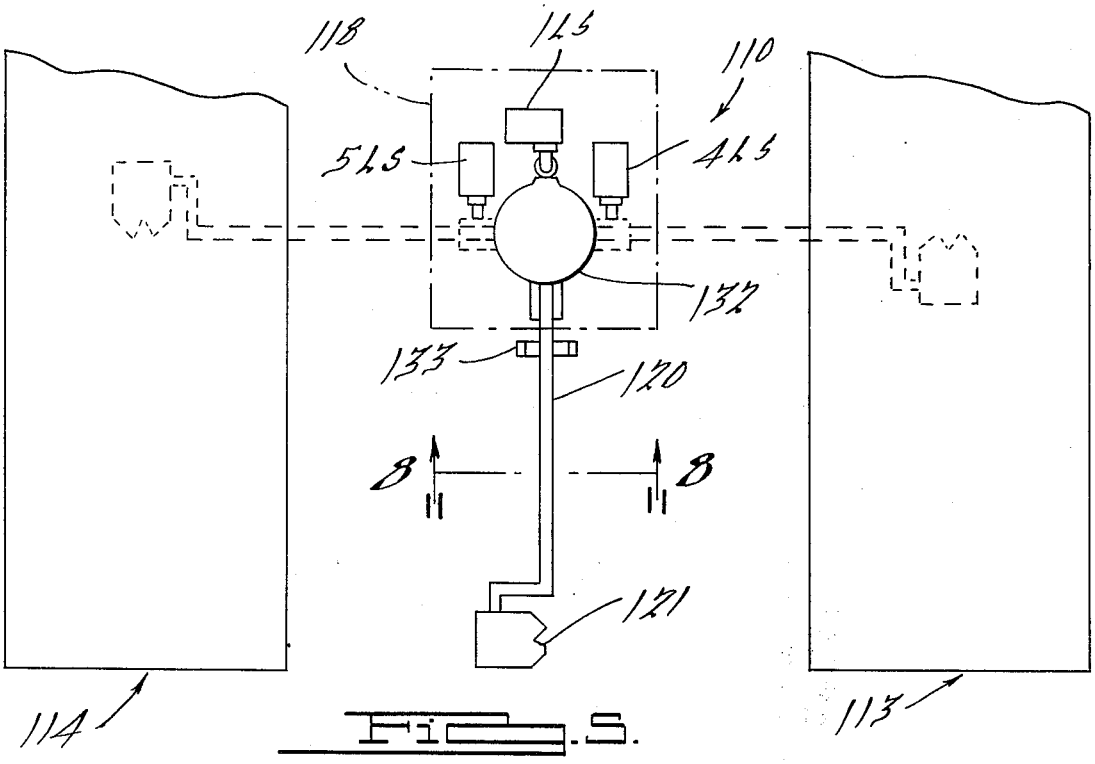
FIGS. 5 and 6 are schematic plan views similar to FIGS. 2 through 4 showing the arrangement of various limit switches for controlling various portions of the automatic cycling of the pouring ladle.

Reference is now made to FIGS. 5 through 9 in order to describe the preferred positioning of the various limit switches used with the apparatus according to this invention in order to provide automatic control over the operation of the entire piston casting installation. As can be seen from a perusal of these figures a plurality of limit switches are positioned in various places about the pouring ladle apparatus 110 in order to be contacted thereby and undergo a change in condition such as "off" to "on" and "on" to "off" depending on the particular limit switch involved. In FIG. 5, ladle 121 is shown in the "fill" position by the solid lines and in the "pouring" position over each of the piston molding machines 113 and 114 respectively by phantom lines. When ladle 121 is in the "fill" position limit switch 1LS is actuated. Limit switch 4LS is actuated when ladle 121 is in the "pour" position at molding machine 114 and limit switch 5LS is actuated when ladle 121 is in the "pour" position for molding machine 113. As can be seen in the Figure these switches 1LS, 4LS and 5LS are positioned in proximity to the rotating means carried by base 118 for contact with various portions thereof. Limit switch 1LS is contacted by a suitably shaped cam surface 131 formed on a portion 132 of rotating means 119. In this particular embodiment, cam surface 131 is positioned on an upper area of rotary portion 132. Limit switches 4LS and 5LS are positioned so as to be contacted by the swinging arm 120 when it has been rotated to the "fill" position over either of the molding machines 113 and 114 as shown and are likewise in an upper area of rotary portion 132. A locking clamp 133 is also shown in this figure and will be described in more detail hereinbelow in connection with FIG. 8. The purpose of clamp 133 is to provide positive assurance that ladle 121 is in the "fill" position and remains there when the holding furnace 115 releases a molten charge of metal to the ladle.

Figure 6:
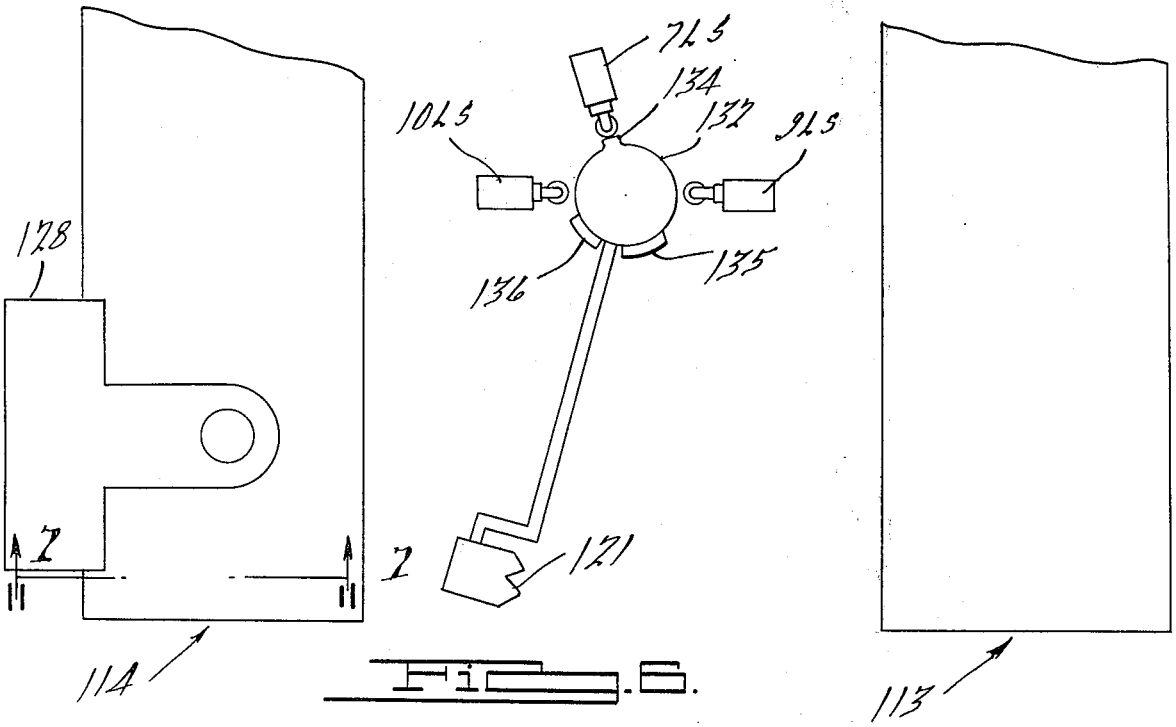
Figure 7:
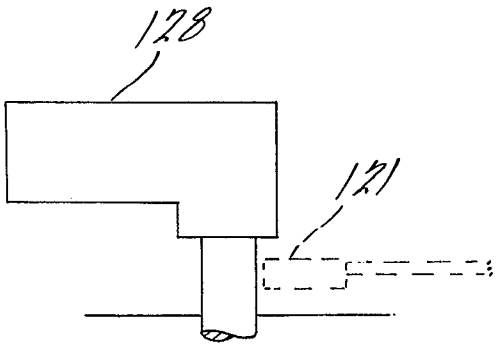
FIG. 7 is a schematic view taken along line 7—7 of FIG. 6 to show the relative position of the automatic pouring ladle relative to a portion of one of the piston molding machines.

Limit switches 7LS, 9LS and 10LS are shown in FIG. 6. These switches for convenience in design are located lower on rotary means portion 132 than switches 1LS, 4LS and 5LS. As can be seen from FIG. 6 these switches are also arranged to co-act with cam surfaces 134, 135 and 136, respectively, which are carried on rotary portion 132. Limit switch 7LS is actuated when ladle 121 is in the "dump" position (safety position) as shown in the drawing and is arranged by means of a timer (described further hereinbelow) to be actuated if ladle 121 has not poured metal within a certain predetermined time, such as 26 seconds, after receiving the molten charge from holding furnace 115. Limit switches 9LS and 10LS are safety limit switches to prevent loader arm 126 and unloader arm 128 from obstructing the travel of the swinging arm 120 and ladle 121. This is only necessary in this particular instance because of the specific design of the commercially available piston molding machines 113 and 114. If any other type of molding machine or molding means is used these switches may not be necessary. Referring to FIG. 7 the relationship of ladle 121 to unloader arm 128 is shown to make clear the necessity of safety switches 9LS and 10LS. Unloader arm 128 must be in a raised position as shown to allow ladle 121 to clear it as it moves over the piston molding machine.

Figure 8:
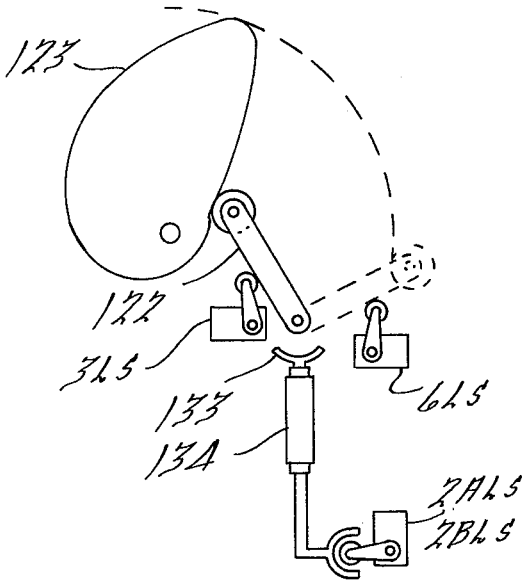
FIG. 8 is a partly sectional view taken along line 8—8 of FIG. 5 showing, with portions of the apparatus removed for clarity, the actuation means and the limit switch arrangement for controlling the actual pouring cycle of the pouring ladle.

FIG. 8 shows the cam and follower arrangement with certain limit switches and clamp 113 previously mentioned in connection with FIG. 5 in more detail. The solid line shows the follower 122 in the position it normally has when the ladle is in the horizontal position such as when it is in the "fill" position. Follower 122 is shown in phantom in a position it assumes as cam 123 rotates to place ladle 121 in the "Fully Poured" position. Limit switch 3LS is shown being actuated by follower 122 to indicate that ladle 121 is in a horizontal position. Limit switch 6LS will be actuated by follower 122 when ladle 121 has completed the pour. As can be seen, clamp 133 is raised and lowered by an air cylinder 134 or the like. Limit switch 2LS is a safety clamp limit switch which indicates whether the clamp is in the "up" or "down" position. When the ladle 121 is in the "fill" position the clamp must be in the "up" position. Limit switch 2LS is indicated in the figure as 2ALS–2BLS indicating that it is of the Neutral Position type.

Figure 9:
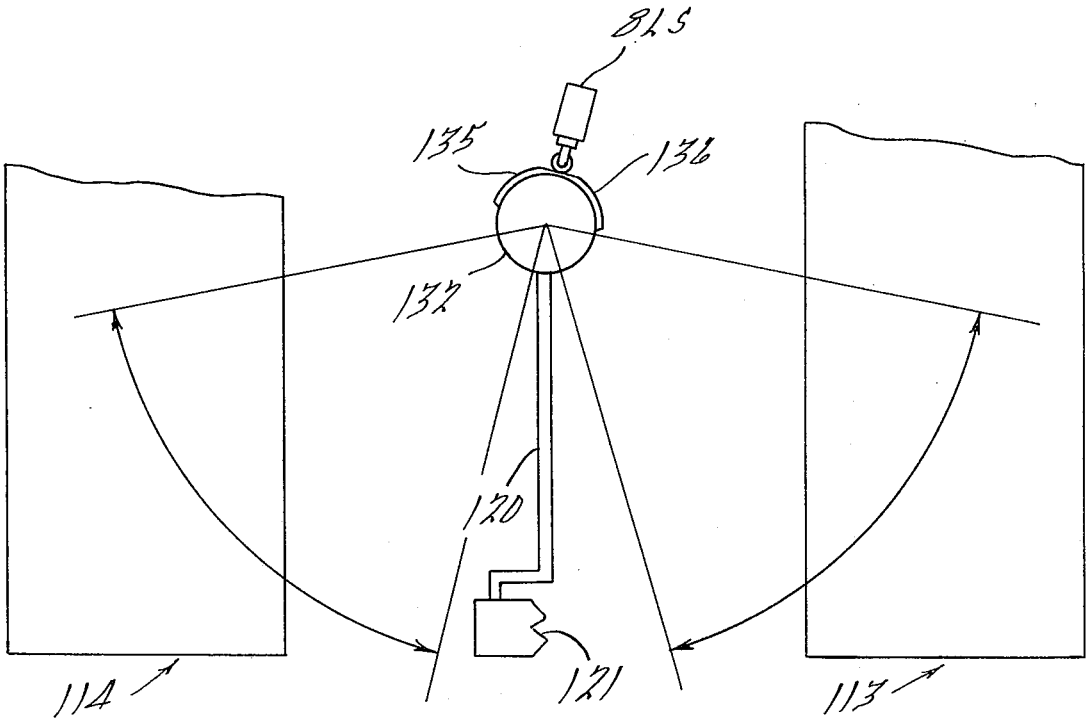
FIG. 9 is another schematic plan view similar to FIGS. 5 and 6 showing the general extent of rotation of the swinging arm relative to the piston molding machine placed to each side of the pouring ladle apparatus and also showing the position of another limit switch which controls the cycling of the pouring ladle.

Referring now to FIG. 9, the last of the limit switches 8LS is shown positioned on a lower portion of rotary body 132 in conjunction with a pair of cam surfaces 135 and 136. The cam surfaces are arranged relative to limit switch 8LS such that it is actuated when ladle 121 is moved from the "fill" position as shown to the "pour" position at both either of the piston machines 113 or 114. Limit switch 8LS is actuated while swinging arm 120 is traveling to the "pour" position over either of the piston molding macines.

Referring to FIG. 10, a mechanism is shown by means of which the ladle 121 may be mounted at the end of arm 120 and also raised or lowered relative to the mold into which the ladle is to pour the molten metal. An air cylinder or similar means 150 actuates a lever arm 152 working on a pivot C which raises and lowers the ladle 121 in guides 154. Filling and transfer of the ladle may be done in the raised position. The ladle is then lowered before being tilted to pour the molds. The lowering of the ladle reduces metal turbulence during pouring by reducing the vertical drop through which the metal falls. This reduction in turbulence eliminates the "skim-gas" type of defect.

Figure 11:
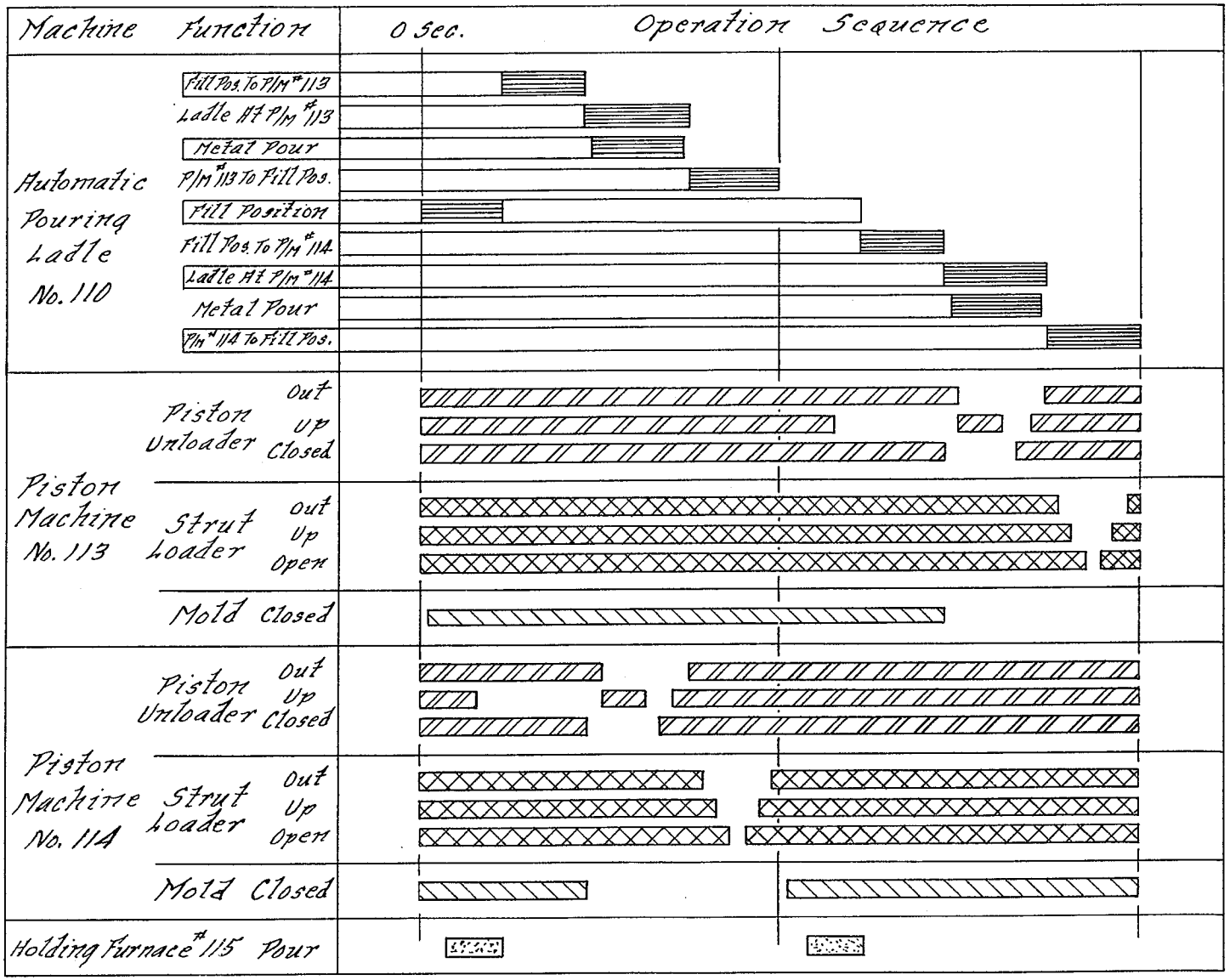
FIG. 11 is a bar type chart showing the operational sequences of the basic components of an entire piston making assembly including an automatic pouring ladle, two piston molding machines and a holding furnace which meters the molten metal into the automatic pouring ladle.
Figure 12A:
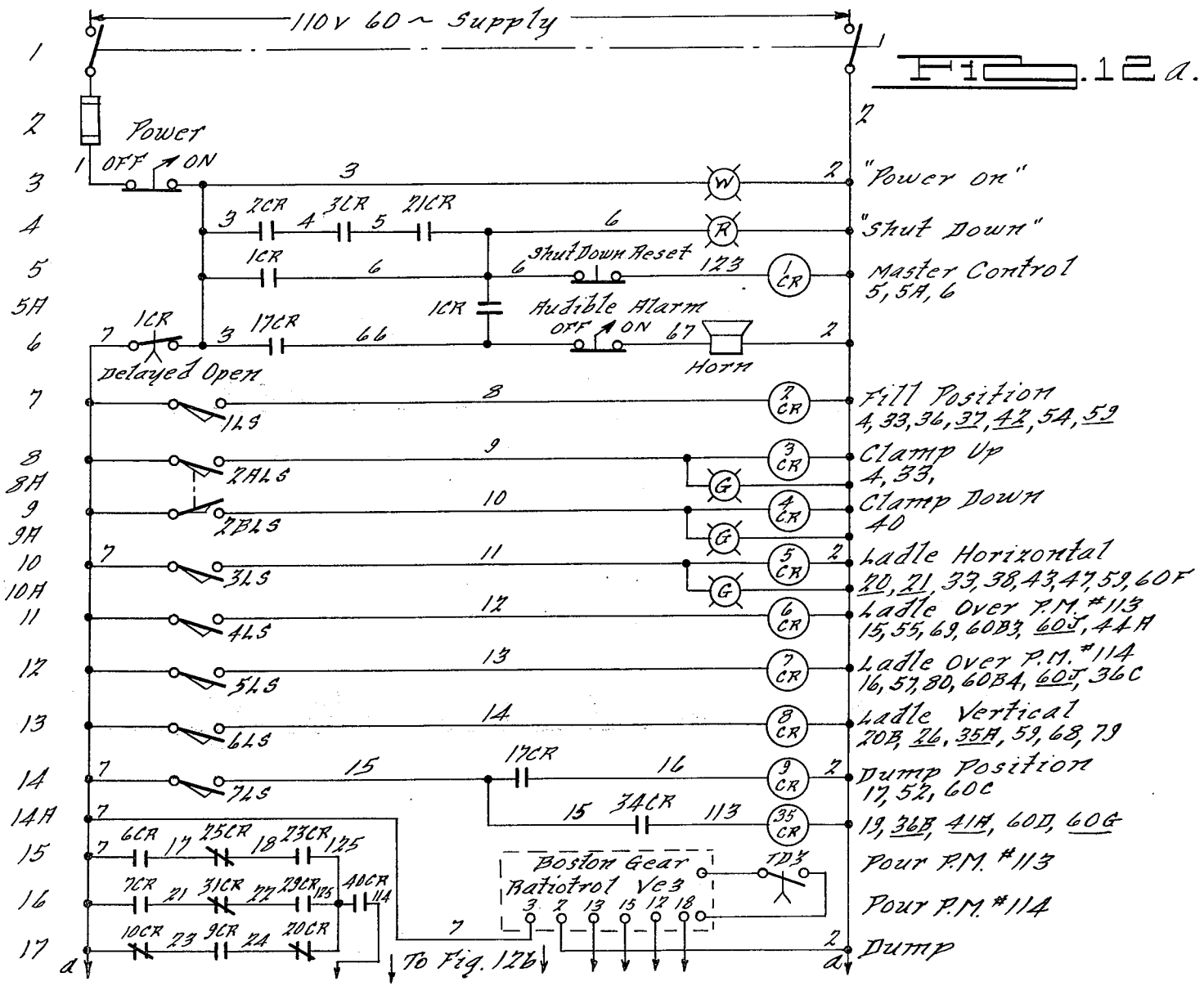
Figure 12B:
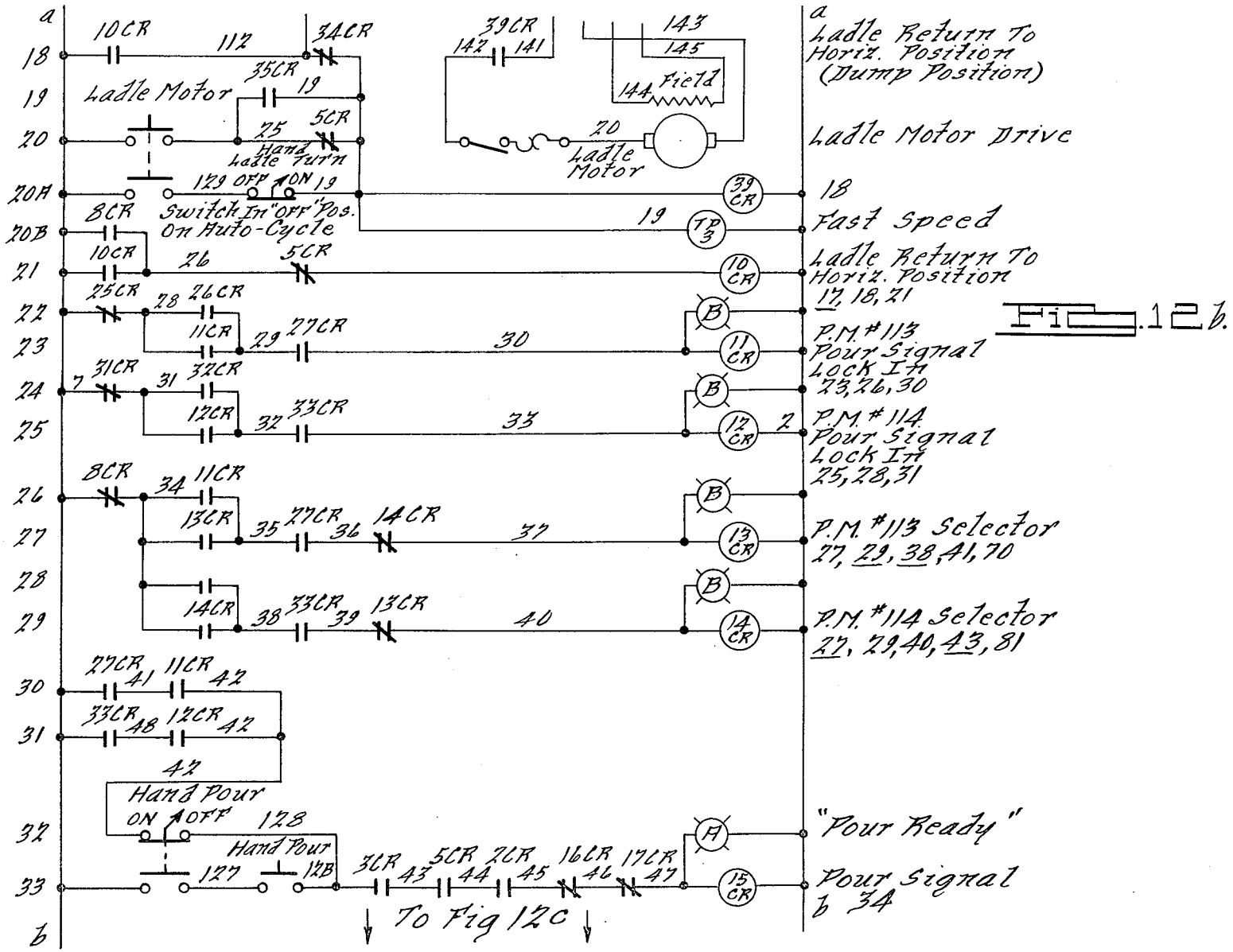
Figure 12C:
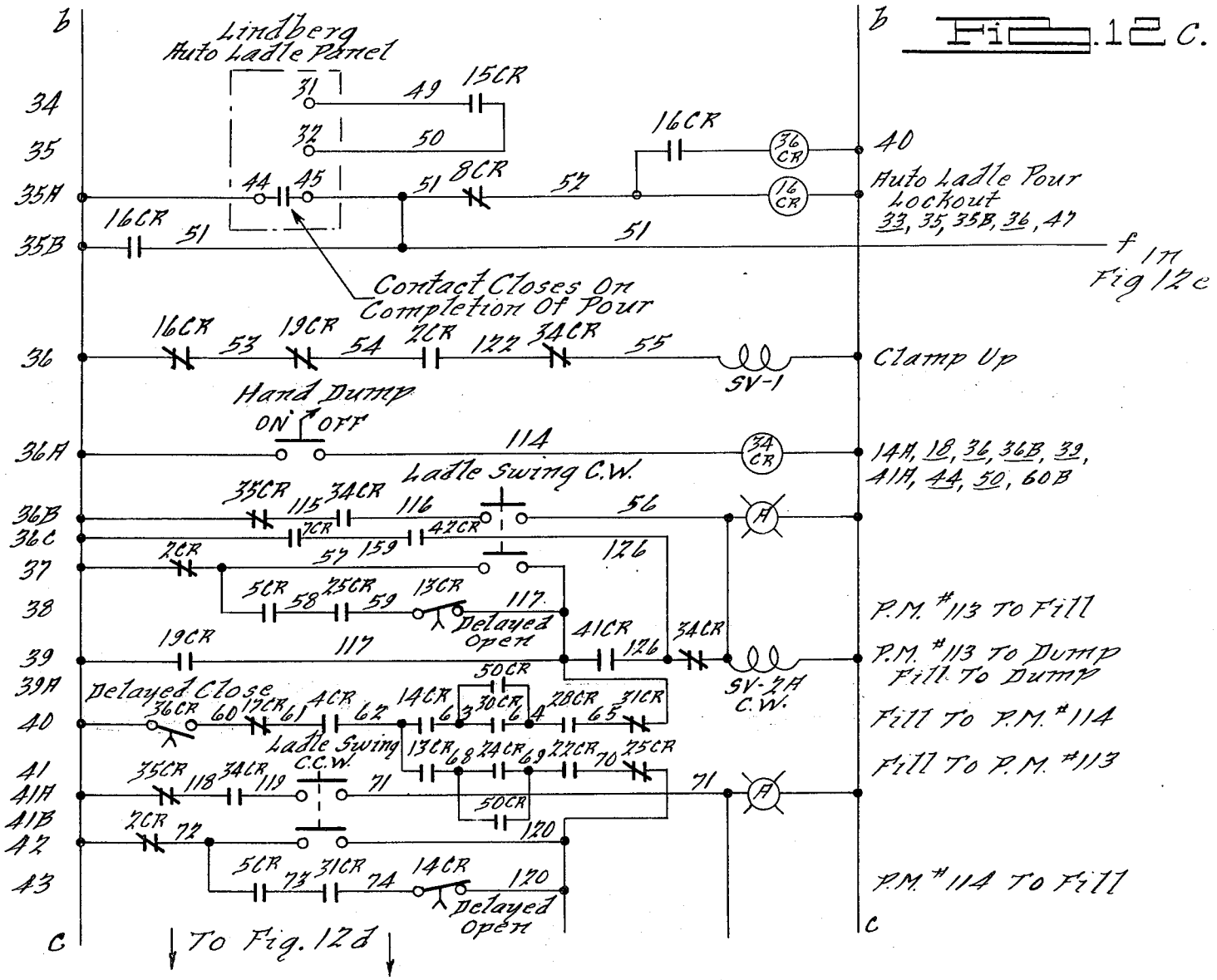
* FIG. 12*c* is a continuation of FIG. 12*b* and connects thereto at common points *b.
Figure 12D:
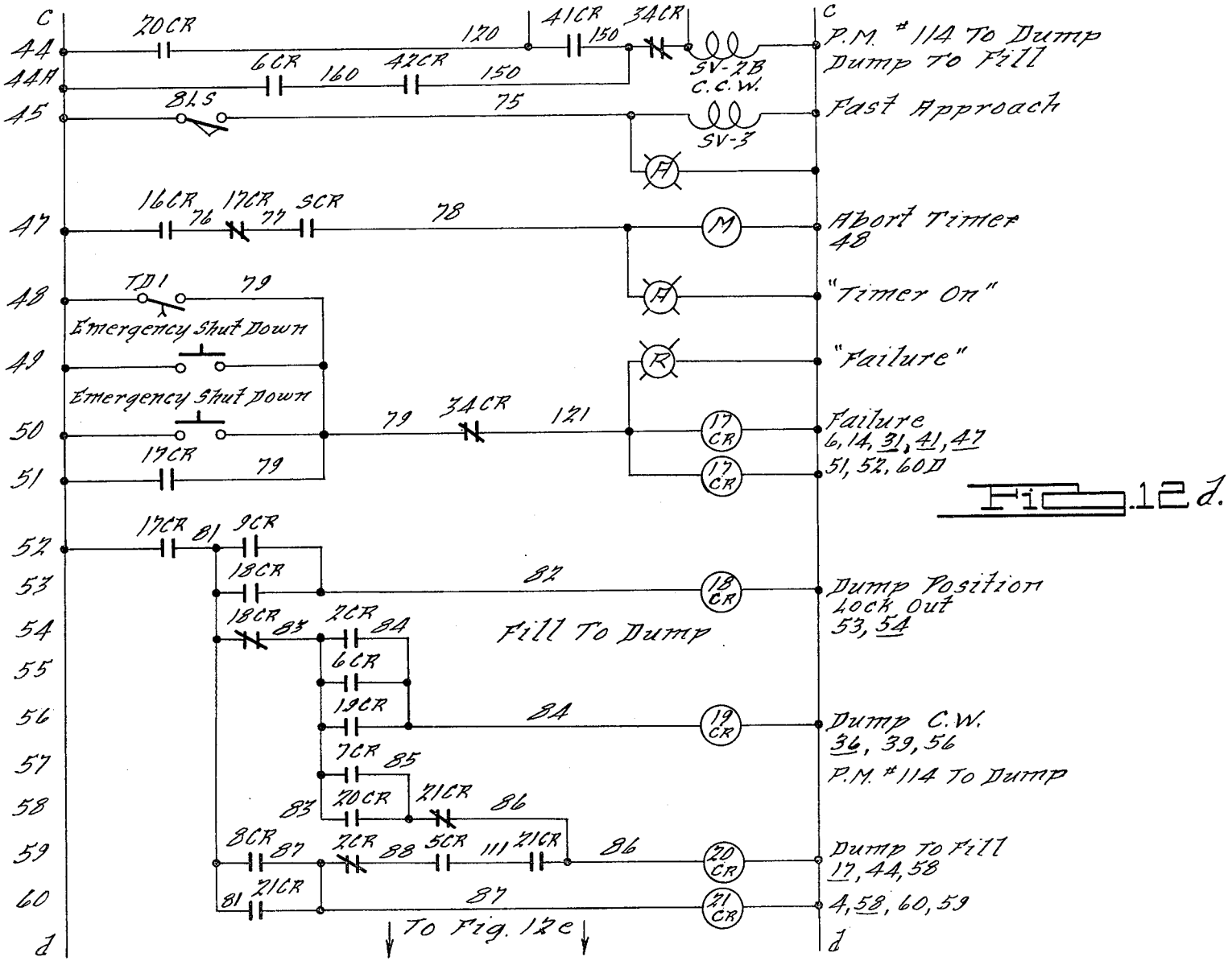
* FIG. 12*d* is a continuation of FIG. 12*c* and connects thereto at common point *c.
Figure 12C:
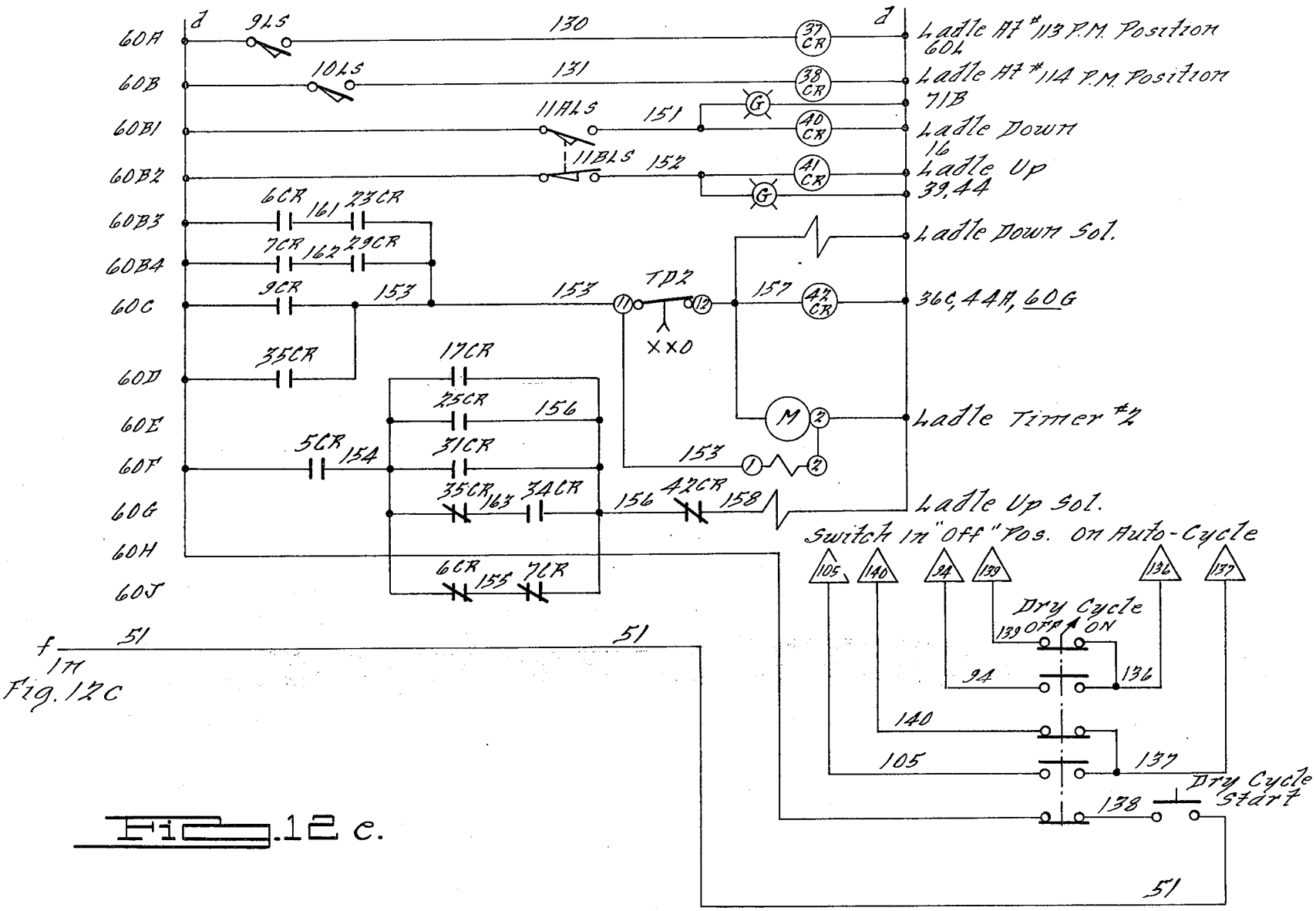
Figure 15C:
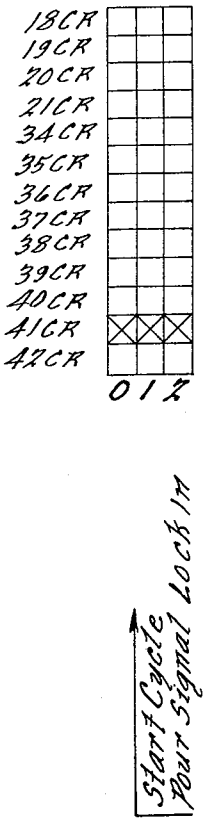
FIG. 15 forms a chart showing the operational sequences of the automatic pouring ladle and the other elements of the piston making assembly in more specific detail with respect to the various electrical components involved in controlling the automated cycling of the entire assembly. The chart is broken up into sections consisting of FIGS. 15*a*, 15*b*, 15*c*, 15*d*, 15*e*, 15*f*, 15*g*, 15*h* and 15*i* arranged as shown in FIG. 16.
Figure 16:
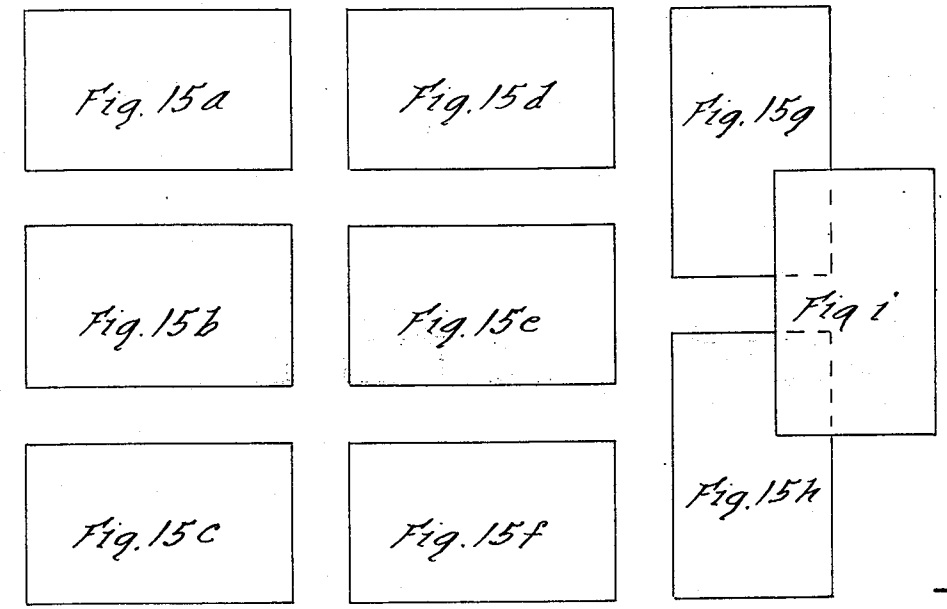
FIG. 16 shows the organizational arrangement for FIGS. 15*a*, *b*, *c*, *d*, *e*, *f*, *g*, *h* and *i* to provide a single large chart. Peripheral portions of the respective FIG. 15 which are the same may be overlapped to secure proper alignment of the overall figure or chart.
Figure 15D:
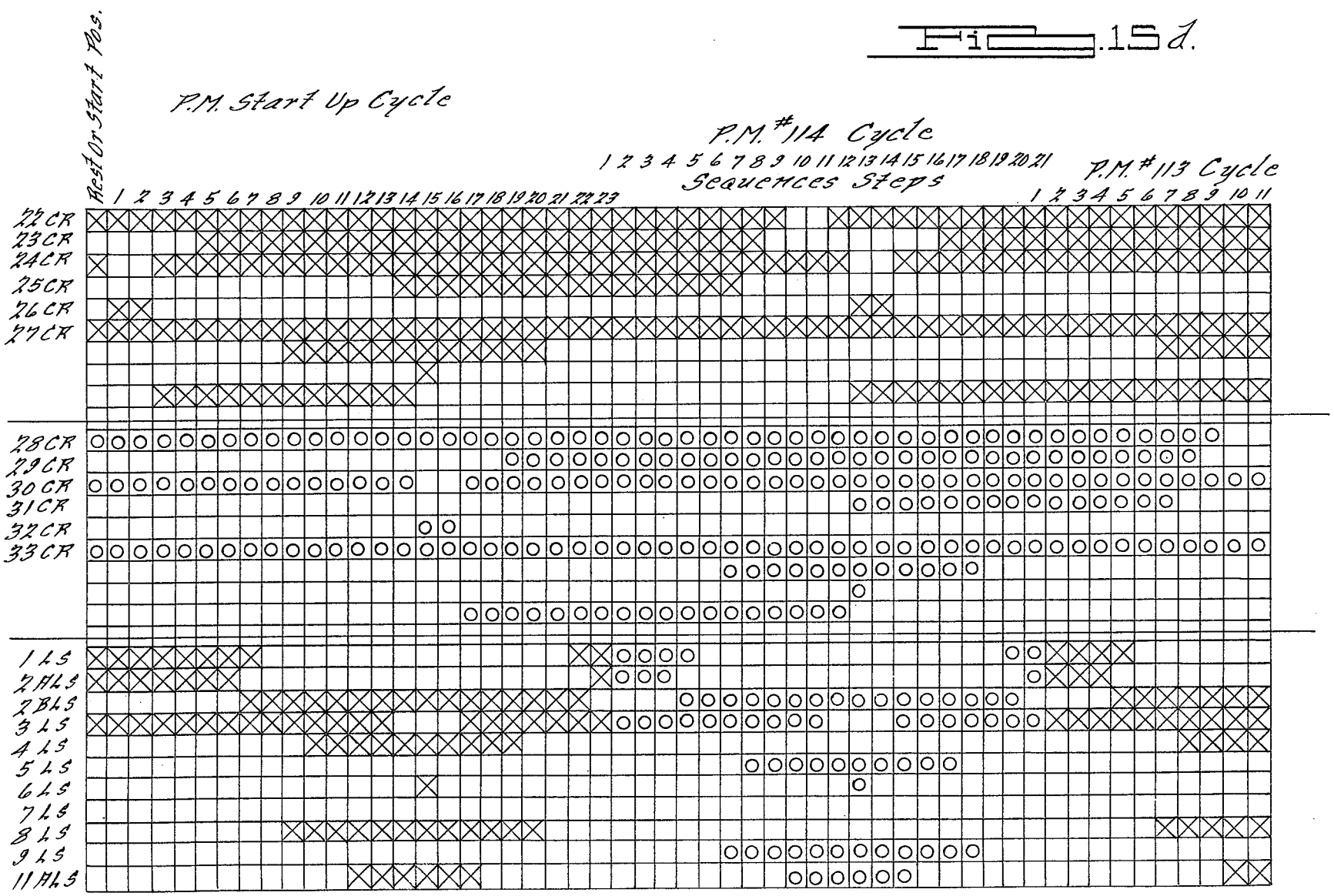
Figure 15C:
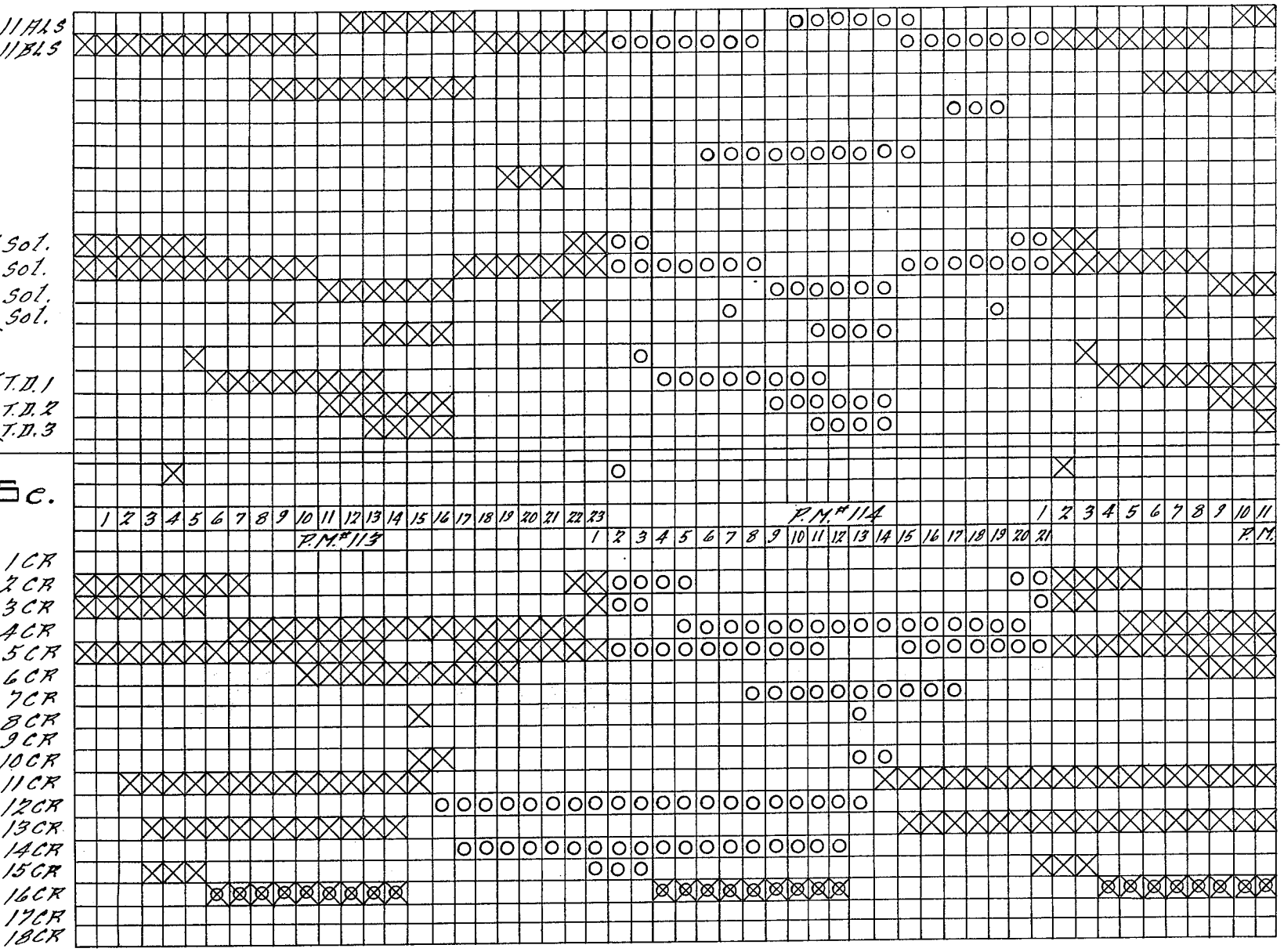
Figure 15G:
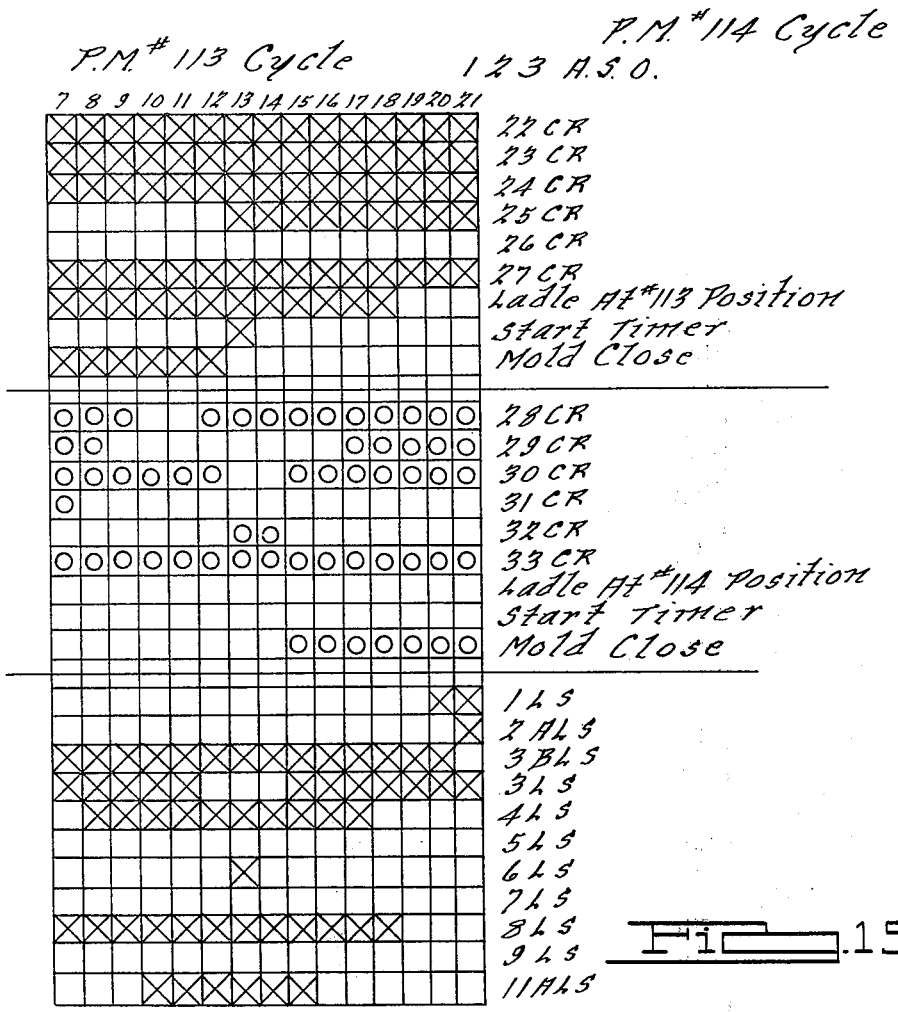
Figure 15I:
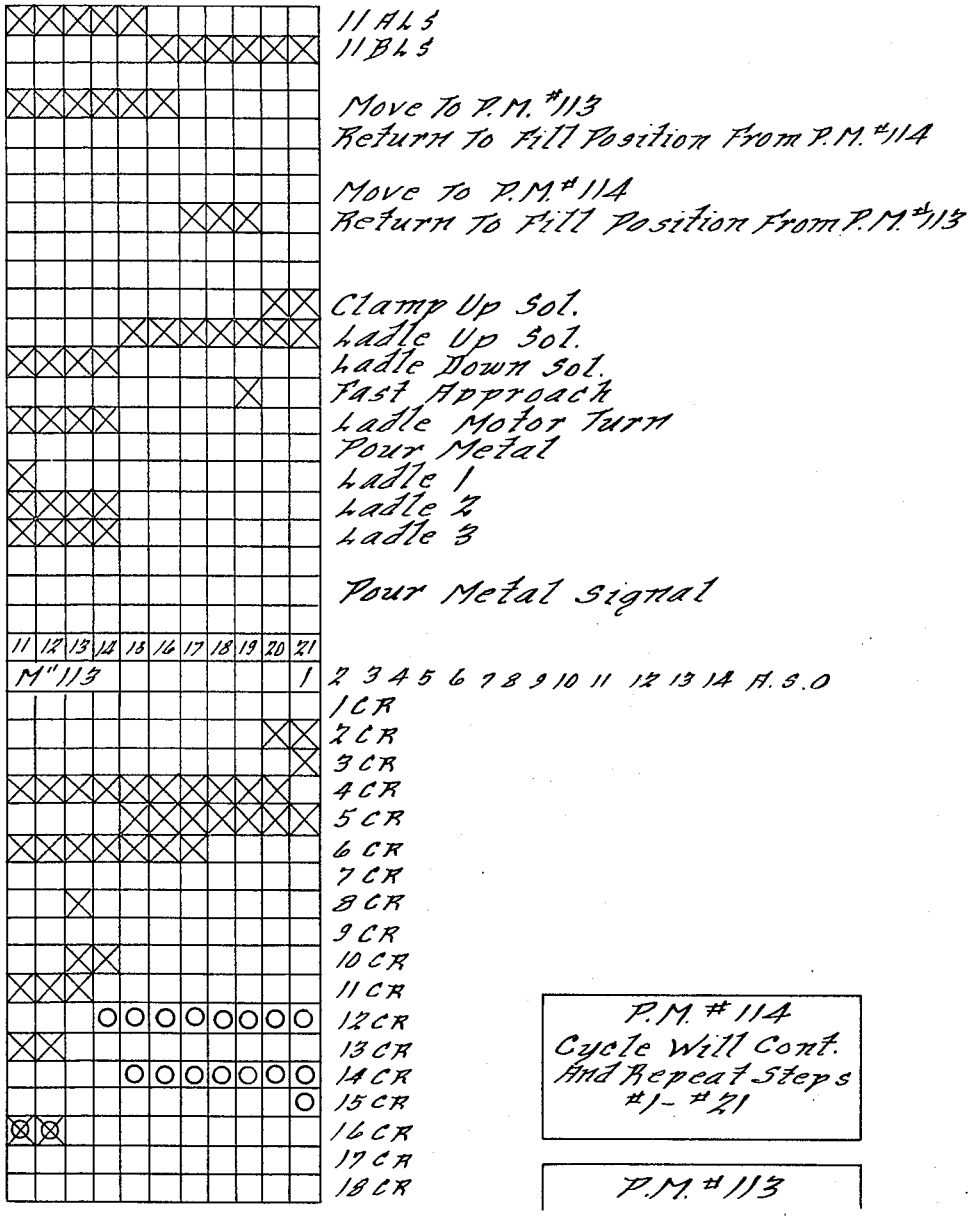

FIG. 11 illustrates the timing of the various operational sequences for the pouring ladle apparatus 110, piston machines (P/M) 113 and 114, and the metering of molten metal from holding furnace 115 which provides a charge to the pouring ladle 121. Under "piston unloader" the designation "out" indicates that unloader arm 128 is moved out of the way of the mold. "Up" indicates that it is in the raised position and "close" indicates that it is gripping the cast pistons to remove them from the mold. Under "strut loader" "out" indicates that loader 126 is swung out of the way of the mold, "up" indicates that it is in a raised position while "open" indicates that loader 126 is not placing struts in the mold.

Before proceeding with a detailed description of the various steps occurring in an operational sequence, it might be helpful to briefly review the overall sequence of operation. As can be seen at this point, four interconnected units are utilized in preferred embodiment of the piston casting installation: two piston molding machines, one holding furnace-dispensing means and one ladle pouring apparatus. The ladle pouring apparatus involves two separate motions, the swing of its swinging arm by means of a rotary means and the tilt of its pouring ladle by means of a cam and lever system.

An automatic cycle is originally started by setting selector switches on each of the four units and starting one of the two piston molding machines. At this point one molding machine will start its strut placing cycle, the ladle pouring apparatus will be in the "fill" position and the holding furnace will be in its ready condition to meter a charge into the ladle. The first molding machine to complete strut placing will interlock the pouring ladle apparatus to its cycle and will interlock the second molding machine out until completion of a first pouring cycle relative to itself. Completion of strut placing initiates the holding furnace which pours a previously determined amount of metal into the pouring ladle. Completion of this pour cycle and verification that the molding machine strut placer arm is clear of the mold initiates the swing of the ladle from the fill point to the pour point at the previously selected piston molding machine. Completion of the ladle movement and verification that the molding machine molds are closed initiates tilt of the ladle to pour the metal into the mold. When the ladle is fully tilted up, a cooling cycle timer on the molding machine is initiated and the molding machine cycles independently through cooling, the molds then open and the pistons are unloaded and struts are placed so that the machine is in the ready condition described at the start of this operation. The pouring ladle apparatus in the meantime will have continued to operate and when it has returned to its horizontal position it will move back to the "fill" position where it will remain until the next pouring cycle is initiated by one or the other of the two molding machines.

As will be seen below in the detailed description of the electrical control circuit according to this invention certain failure safe guards are provided. The start of the metal metering from the holding furnace into the ladle initiates an abort timer in the ladle pouring apparatus circuit. This timer ceases to operate normally when the pour sequence is completed and the ladle has returned to the horizontal position. If some portion of the operation takes too long or fails completely the timer times out and a failure sequence is initiated. Preferably, a horn or the like will sound while the ladle is moved from any position it happens to be in to a "dump" position. Verification that it is in the dump position initiates ladle tilting to pour the metal into a suitable drain pan or the like. When the ladle has returned to the horizontal position after dumping the molten charge, it is moved back to the "fill" position. At this point the electrical control circuit will shut the apparatus down and it must be re-set by an operator who has investigated the alarm. The molding machines continue to cycle to their ready condition.

Referring now to FIGS. 12, 13, 14, 15 and 16, the electrical inter-relationship of the piston molding machines, the furnace metering device and the pouring ladle device will be discussed in detail. FIG. 12 is an electrical schematic of the circuit for the ladle pouring apparatus. FIG. 13 is an electrical schematic of the inter-connecting circuit between the ladle pouring apparatus electrical circuit and the electrical circuit of the piston molding machine 113. FIG. 14 is a similar inter-connecting circuit between the ladle pouring apparatus and piston molding machine 114. FIG. 15 is a sequence chart showing the relationship of the mechanical and limit switch operation described in FIGS. 1 and 11 and their relationship to the functioning of the electrical elements shown in the schematic of FIGS. 12, 13 and 14. The electrical sequence involved in the automatic ladle pouring device operation and the associated automatic piston molding machines together with the furnance metering unit will now be described in a step by step manner referring to FIG. 15 and the electrical schematics of FIGS 12, 13, and 14.

Rest or Start Position

At this stage, all four units involved, namely the two permanent molding machines, the pouring ladle, and the furnace metering unit, have been turned on and are ready to go but no production has yet occurred. In this position, on piston machine 113, the unloader is over the discharge, the loader is over the pick-up and the machine is in the automatic cycling position. In FIG. 13, this involves 22CR (control relay), 24CR and 27CR being energized. 27CR stays energized so long as production is in progress and will not be referred to subsequently. Similarly for piston machine (P.M.) 114, the unloader is over the discharge, the loader is over the pick-up and the machine is in the automatic cycle position. Again, this involves 28CR, 30CR and 33CR being energized and these are shown in FIG. 14. 33CR remains energized so long as production is in progress and will not be referred to any further. On the pouring ladle device, the ladle is in the "fill" position, the clamp is up, the ladle is in the horizontal position and the ladle is in the "up" position. In FIG. 12, 1LS (limit switch), 2ALS, 3LS and 11BLS are all in a closed position. The "Clamp-up" solenoid and the "ladle-up" solenoid are energized; the ladle unit is providing out-going signals by contact relays 2CR, 3CR, 5CR and 41CR being energized and indicating that the unit is in the "fill" position with the clamp up, the ladle horizontal and the ladle in the "up" position.

P.M. 113 Cycle

Step No. 1 — Start Cycle

For the purposes of the description, it is assumed that P.M. 113 leads by going into its automatic cycle and bringing its loader into the down position by energizing 26CR. The "loader over the pick-up" contact relay 24CR is de-energized. No other changes take place at this stage.

P.M. 113 Cycle.

Step No. 2 — Pour Signal Lock-In

The action described in Step No. 1 results in the pouring ladle issuing a signal that P.M. 113 pour signal is locked in by the closing of 11CR in FIG. No. 12. All other electrical conditions remain the same as in preceding Step No. 1.

P.M. 113 Cycle

Step No. 3 — P.M. Selector

At this stage P.M. 113 loader over the pick-up receives an incoming signal which energizes 24CR and an incoming signal de-energizes the "loader down" control relay 26CR. An outgoing signal that the mold close is issued. In FIG. 12 the pouring ladle issues to signals, first that P.M. 113 has been selected by energizing 13CR and second that the pour is required by energizing 15CR. All other electrical conditions remain the same as in preceding Step No. 2.

P.M. 113 Cycle

Step No. 4 — Pour Ready Signal

The pour ladle in FIG. 12 now issues an instruction to the metering furnace to pour metal. All other electrical conditions remain as in preceding Step No. 3.

P.M. 113 Cycle

Step No. 5 — Pour Metal

A signal from P.M. 113, FIG. No. 13 is now issued to the pouring ladle that the molds have closed by the energizing of 23CR and the metering furnace now pours metal. All other electrical conditions remain the same as in preceding Step No. 4.

P.M. 113 Cycle

Step No. 6 — Pour Lock-Out

At this stage, the metal has been poured from the furnace to the ladle and the "clamp-up" solenoid FIG. 12 is de-energized as is the automatic metering furnace. The abort timer is started by energizing TD1. The "clamp-up" solenoid was de-energized by the de-energizing of 3CR. A signal enters the pouring ladle from the metering furnace that the metering furnace is locked out and can no longer pour by the energizing of 16CR. All other electrical functions in Step No. 6 are the same as in preceding Step No. 5.

P.M. 113 Cycle

Step No. 7 — Clamp Down

The pouring ladle now receives a signal that the clamp is down by the closing of 2BLS and the opening of 2AlS. The "Clamp Down" relay 4CR is energized, 36 CR is also energized to give the autoladle pour lock-out. All other electrical functions are the same as in the preceding Step No. 6.

P.M. 113 Cycle

Step No. 8 — Pouring Ladle Movement Counter-Clockwise

In FIG. 12, 1LS is open indicating that the pouring ladle is no longer is the "fill" position. 2CR de-energizes again because the pouring ladle is no longer in the "fill" position. The pouring ladle now is moving from the "fill" position to the P.M. 113 position. All other electrical functions are the same as in preceding Step No. 7.

P.M. 113 Cycle

Step No. 9 — Ladle at P.M. 113 Position

A signal now goes to P.M. 113 that the pouring ladle is at P.M. 113 position. This signal is provided by the closing of 8LS indicating that the ladle is at P.M. 113. The fast approach solenoid is energized and 37CR in FIG. 12 is energized with the ladle at the P.M. 113 position. All other electrical functions are the same as in preceding Step No. 8.

P.M. 113 Cycle

Step No. 10 — Ladle in P.M. 113 Position

In FIG. 12, 4LS is closed with the ladle in the P.M. 113 position and the fast approach solenoid is now de-energized. 6CR is now energized with the ladle in the P.M. 113 position. All other electrical functions at this stage are the same as in Step No. 9.

P.M. 113 Cycle

Step No. 11 — Ladle Down

In FIG. No. 12 the pouring ladle ceases to indicate it is in the up position by the opening of 11BLS. The "ladle up" solenoid is de-energized and the ladle up control relay 41CR is de-energized and the "ladle down" solenoid is energized. Ladle timer TD2 is now in the on position. The "ladle down" control relay 42CR is now energized. All other electrical functions are the same as in preceding Step No. 10.

P.M. 113 Cycle

Step No. 12 — Ladle Fully Down

The closing of 11ALS in FIG. 12 now indicates that the ladle is in the down position. The ladle down control relay 40CR is now energized. All other electrical functions are the same as in the preceding Step. No. 11.

P.M. 113 Cycle

Step No. 13 — Ladle Motor Turning

Ladle motor drive on control relay No. 39CR is now energized as is the fast speed timer TD3. The ladle motor is now turning rotating the ladle to give a pour. All other electrical functions are the same as in preceding Step No. 12.

P.M. 113 Cycle

Step No. 14 — Ladle Motor Turning

At this stage, the energizing of cooling cycle timer control relay 25CR in FIG. 13 occurs. In FIG. 12 the opening of limit switch 3LS indicates the ladle is no longer horizontal. The abort timer TD1 is now de-energized, and the "ladle horizontal" control relay No. 5CR is de-energized. All other electrical functions are the same as in the preceding step No. 13.

P.M. 113 Cycle

Step No. 15 — Ladle Vertical — P.M. 114 Cycle — Start Cycle

In FIG. 13 a signal is issued to P.M. 113 to start the timer in that machine and the mold close signal is cancelled. In FIG. 14 the P.M. 114 loader over pick-up control relay No. 30CR is de-energized and the loader down control relay 32CR is energized. In FIG. 12 the fact that the ladle is now vertical is signalled by the closing of 6LS and the ladle vertical control relay 8CR is energized. The "ladle return to horizontal position" No. 10CR is also energized and the selection of P.M. 113 as the machine to be poured by the pouring ladle is cancelled by the de-energizing of 13CR. The incoming signal from the autoladle that it is locked out is cancelled by the de-energizing of the "Autoladle Pour Lock-Out" control relay No. 16CR and the "Autoladle Pour Lock-Out" Control relay 36CR is also de-energized. All other functions are the same as in preceding Step No. 14.

P.M. 113 Cycle

Step No. 16 — Ladle Return to Horizontal — P.M. 114 Cycle — Pour Signal Lock The "ladle vertical" control relay 8CR de-energizes in FIG. 12. The "P.M. 113 pour signal lock-in" control relay 11CR also de-energizes and the "P.M. 114 pour signal lock-in" control relay 12CR now energizes. All other electrical functions remain the same as in Step No. 15.

P.M. 113 Cycle

Step No. 17 — Ladle Horizontal — P.M. 114 Cycle — P.M. 114 Selector

In FIG. 14, the "loader down" control relay 32CR is de-energized, "loader over pick-up" control relay 30CR energizes and P.M. 114 receives an outgoing signal to close the mold. In FIG. 12 the ladle horizontal position is indicated by the closing of limit switch 3LS energizing "ladle horizontal" control relay 5CR. The "ladle up" solenoid is now energized and the "ladle down" solenoid is de-energized. The ladle motor ceases to turn and the ladle timer TD2 is stopped as is the faster speed timer TD3. The "ladle return to horizontal position" control relay 10CR is de-energized. The "P.M. 114 selector" control relay 14CR is now energized indicating that P.M. 114 has been selected as the next machine to be poured by the pouring ladle. The "ladle motor drive" control relay 39CR is now de-energized. All other electrical functions are the same as in preceding Step No. 16.

P.M. 113 Cycle

Step No. 18 — Ladle Up

In FIG. 12 the fact that the ladle is up is indicated by the closing of 11BLS and the opening of 11ALS. THe "counter-clockwise solenoid" is now de-energized, the "ladle down" control relay 40CR and 42CR are now de-energized and the "ladle up" control relay 41CR is now energized. All other electrical functions are the same as in preceding step No. 17.

P.M. 113 Cycle

Step No. 19 — Transfer Device Return to Fill Pposition

On P.M. 114 in FIG. 14, the energizing of the "mold halves closed" control relay 29CR occurs. In FIG. 12, the "clockwise solenoid" is energized permitting the transfer device (TD) to move from the P.M. 113 position to the "fill" position. All other electrical functions are the same as in preceding Step No. 18.

P.M. 113 Cycle

Step No. 20 — Transfer Device Returning to Fill Position

In FIG. 12 the transfer device indicates that it is no longer in the P.M. 113 position by the opening of 4LS and "ladle in P.M. 113 position" control relay 6CR is now de-energized. All other electrical conditions are the same as in preceding Step No. 19.

P.M. 113 Cycle

Step No. 21 — Transfer Device Returning to Fill Position

In FIG. 13 the signal that the transfer device is at the PM 113 position has been cancelled. In FIG. 12, the opening of 8LS indicates that the transfer device is no longer at the P.M. 113 position. The "fast approach solenoid" is now energized. The "transfer device at P.M. 113 position" control relay 37CR is now de-energized. All other electrical functions are the same as in preceding Step No. 20.

P.M. 113 Cycle

Step No. 22 — Transfer Device in Fill Position

In FIG. 12, the transfer device in the fill position is indicated by the closing of 1LS. The "clockwise rotation solenoid" is de-energized and the clamp up solenoid is energized. The "fast approach solenoid" is de-energized. The "fill" position control relay 2CR is now energized. All other electrical functions are the same as in preceding Step No. 21.

P.M. 113 Cycle

Step No. 23 — Clamp Up. P.M. 114 Cycle. Step No. 1 — Pour Ready

The closing of 2ALS indicates that the clamp is in the up position. The "clamp down" limit switch 2BLS now is open. The "clamp up" control relay 3CR is now energized and the "clamp down" control relay 4CR is now de-energized. The "pour signal" control relay 15CR is now energized. All other electrical functions are the same as in preceding Step No. 22.

P.M 114 Cycle

Step No. 2 — Pour Ready Signal

A signal is transmitted to the furnace metering device to pour the metal by the closing of "pour signal" control relay 15CR in the preceding step. All other electrical functions are the same as in preceding Step No. 23–1.

P.M. 114 Cycle

Step No. 3— Pour Metal

The autoladle having received the signal to meter metal now proceeds to go into its pour cycle. All other electrical functions in FIGS. 12, 13 and 14 remain as in preceding Step No. 22.

P.M. 114 Cycle

Step No. 4 — Pour Lock-Out

A signal arriving from the Lindberg autoladle that the autoladle unit is now locked out and has stopped pouring, de-energizes "pour signal" control relay 15CR and energizes the "autoladle pour lock-out" control relay 16CR. The "clamp up" control relay 3CR and the "clamp up" solenoid are now de-energized making it possible for the transfer device to move from the fill position. The "abort timer" TD1 is now started so that if the pouring of the pistons is not accomplished in the period the timer is set for, the unit will enter into the abort cycle. All other electrical functions remain the same as in the preceding P.M. 114 cycle — Step No. 3.

P.M. 114 Cycle

Step No. 5 — Clamp-Down

"Autoladle pour lock-out" control relay 36CR is now energized as is the "clamp down" control relay 4CR. The "clamp up" limit switch 2ALS is open and the "clamp down" limit switch 2BLS is closed. All other electrical functions remain the same as in the preceding P.M. 114 cycle — Step No. 4.

PM. 114 Cycle

Step No. 6 — Transfer Device Moved Clockwise

"Fill position" control relay 2CR is now de-energized, and energizing of the "clockwise motion" solenoid starts the transfer device moving from the fill position to the PM 114 position. Limit switch 1LS opened indicating the transfer device is no longer in the fill position. All other electrical functions remain the same as in the preceding P.M. 114 cycle — Step No. 5.

P.M. 114 Cycle

Step No. 7 — Transfer Device at P.M. 114 Position

The closing of limit switch 9LS now indicated that the transfer device is at the P.M. 114 position and the "fast approach" solenoid is energized. The closing of the "transfer device at P.M. 114 position" control relay 38CR issues a signal to P.M. 114, FIG. 14 that the transfer device is now at the P.M. 114 position. All other electrical functions remain the same as in P.M. 114 Cycle — Step No. 6.

P.M. 114 Cycle

Step No. 8 — Transfer Device in P.M. 114 Position

The "fast approach" solenoid is de-energized and the closing of limit switch 5LS indicates that the transfer device is in the P.M. 114 position. "Transfer device in P.M. 114 position" control relay 7CR is now energized. In FIG. 13 an incoming signal from P.M. 113 de-energizes "cooling cycle timer" control relay 25CR. All other electrical functions remain the same as in preceding P.M. 114 Cycle — Step No. 7.

P.M. 114 Cycle

Step No. 9 — Ladle Down

The closing of 5LS in preceding Step No. 8 results in the de-energizing of "ladle up" control relay 41CR and the energizing of "ladle down" control relay 42CR. The "ladle up solenoid" is de-energized and the "ladle down solenoid" is energized. The movement of the ladle in a downward direction results in the opening of "ladle up" limit switch 11 BLS. "Ladle timer" TD2 is now started. In Fig. 13 a signal is received from P.M. 113 which de-energizes the "mold half closed" control relay 23CR. All other electrical functions remain the same as in preceding P.M. 114 cycle — Step No. 8.

P.M. 114 Cycle

Step No. 10 — Ladle Fully Down

The closing of "ladle down" limit switch 11ALS now indicates that the ladle is in the fully down position. This results in the energizing of "ladle down" control relay 40CR. At the same time in FIG. 13 an incoming signal from P.M. 113 indicates that the unloader has now left the discharge position and de-energizes control relay 22CR. All other electrical functions remain the same as in preceding P.M. 114 cycle — Step No. 9.

P.M. 114 Cycle

Step No. 11 — Ladle Motor Turned

Ladle motor drive on control relay 39CR is now energized and the ladle motor starts to turn to pour the piston molds in P.M. 114. "Fast speed" timer TD is now started. All other electrical functions remain the same as in preceding P.M. 114 cycle — Step No. 10.

P.M. 114 Cycle

Step No. 12 — Ladle Motor Turning

Ladle horizontal limit switch 3LS is now opened indicating that the ladle has turned from the horizontal position. The "ladle horizontal" control relay 5CR is now de-energized, the "abort timer" TD1 is also de-energized. A signal from P.M. 113 meanwhile energizes the "unloader over discharge" control relay 22CR. All other electrical functions remain the same as in preceding P.M. 114 cycle, Step No. 11.

P.M. 114 Cycle

Step No. 13 — Ladle Vertical

As the ladle turns to pour the piston mold in P.M. 114 it reaches a vertical position and closes limit switch 6LS. This results in the energizing of "ladle vertical" control relay 8CR. "Ladle return to horizontal position" control relay 10CR is also energized. The P.M. 114 selector control relay 14CR, the incoming signal "autoladle pour lock-out" control relay 16CR and the "autoladle pour lock-out" control relay 36CR are de-energized. In FIG. 14 a signal is sent to P.M. 114 to start the timer in that machine, and the "mold close" signal is cancelled. An incoming signal from P.M. 114 energizes "cooling cycle timer" control relay 31CR. Meanwhile P.M. 113 in FIG. 13 sends a signal which de-energizes the "loader over pick-up" control relay 24CR. A signal sent by P.M. 113 also energizes "loader down" control relay 26CR. All other electrical functions remain the same as in preceding P.M. 114 cycle — Step No. 12.

P.M. 114 Cycle

Step No. 14 — Ladle Return to Horizontal — P.M. 113 Cycle. Pour Signal Lock

The ladle is now returning to the horizontal position and the "ladle vertical" limit switch 6LS is now opened. "Ladle vertical control" relay 8CR is de-energized. The signal going to P.M. 114 in FIG. 14 to start the timer in that piston molding machine ceases. A signal coming from P.M. 114 ceases and "P.M. 114 pour signal lock-in" control relay 12CR drops out. At the same time a signal from P.M. 113, FIG. 13 energizes "P.M. 113 pour signal lock-in" control relay 11CR. All other electrical functions remain the same as in preceding P.M. 114 cycle — Step No. 13.

P.M. 114 Cycle

Step No. 15 — Ladle Horizontal — P.M. 113 Cycle Selector

The closing of limit switch 3LS now indicates that the ladle has returned to the horizontal position. "Ladle horizontal" control relay 5CR is now energized. The "ladle return to horizontal position" control relay 10CR is de-energized, and "ladle motor drive on" control relay 39CR is de-energized. The ladle motor thus ceases to turn. The "ladle down" solenoid is de-energized and the "ladle up" solenoid is now energized. "Ladle timer" TD2 is cancelled as is the "fast speed timer on" TD3.

P.M. 113 functions occurring at this stage are that signals issued by P.M. 113 in FIG. 13 energize the "loader over pick-up" control relay 24CR and de-energize the "loader down" control relay 26CR. A signal is sent to P.M. 113 to close the mold and the "P.M. 113 selector" control relay 13CR is now energized. All other electrical functions remain the same as in preceding P.M. 114 cycle — Step No. 14.

P.M. 114 Cycle

Step No. 16 — Ladle Up

In FIG. 12 the "ladle down" limit switch 11ALS is now opened and the "ladle up" limit switch 11BLS is closed indicating that the ladle is now in the up position. The "ladle up" control relay 41CR is now energized and the "clockwise rotation solenoid" is now de-energized. The transfer device is now ready to return to the fill position. "Ladle down" control relay 40CR and 42CR are now de-energized. All other electrical functions remain the same as in preceding P.M. 114 cycle — Step No. 15.

P.M. 114 Cycle

Step No. 17 — Transfer Device return to Fill Position

The "counter-clockwise solenoid" is now energized causing the transfer device to move from the P.M. 114 position to the fill position. All other electrical functions remain the same as in preceding P.M. 114 cycle. Step No. 16.

P.M. 114 Cycle

Step No. 18 — Transfer Device Returning to Fill Position

"Transfer device in P.M. 114 position" limit switch 5LS is now opened as the transfer device returns to the fill position. This results in the de-energizing of "transfer device in P.M. 114 position" control relay 7CR. All other electrical functions remain the same as in the preceding P.M. 114 cycle — Step No. 17.

P.M. 114 Cycle

Step No. 19 — Transfer Device Returning to Fill Position

"Transfer device at P.M. 114 position" limit switch 9LS is now opened. "Transfer device at P.M. 114 position" control relay 38CR is de-energized and the "fast approach solenoid" is energized. In FIG. 14 the outgoing signal to P.M. 114 that the transfer device is at P.M. 114 is now cancelled. All other electrical functions remain the same as in preceding P.M. 114 cycle — Step No. 18.

P.M. 114 Cycle

Step No. 20 — Transfer Device in Fill Position

The transfer device arriving in the "fill" position closes limit switch 1LS. "Fill position" control relay 2CR is now energized, the "counter-clockwise rotation solenoid" is de-energized causing the transfer device to stop moving. The "clamp-up" solenoid is now energized to lock the transfer device in the fill position. All other electrical functions remain the same as in preceding P.M. 114 cycle — Step No. 19.

Note: With the aid of FIGS. 12, 13, 14, 15 and 16 the electrical inter-relationships between the transfer device, P.M. 113, P.M. 114, and the Lindberg Autoladle have been followed from the start-up of the combined units through the first pouring of P.M. 113 and then the first pouring of P.M. 114. During the P.M. 114 cycle, the P.M. 113 molding machine has completed its cycle and at this stage is ready to be poured a second time. During the P.M. 114 cycle description, reference has been made to steps occurring in the P.M. 113 cycle. In the subsequent, second description of the P.M. 113 cycle, reference will be made to the completion of the P.M. 114 machine molding cycle. What is being described is the start of a continuous action where as one piston molding machine is poured, the other piston molding machine is becoming ready for pouring and as soon as the transfer device is available, it will service the second piston molding machine by pouring it. This repetitive cycle continues until such time as the interrelated units are shut down.

P.M. 114 Cycle

Step No. 21 — Clamp Up. P.M. 113 Cycle. Step No. 1 — Pour Ready

The clamp, in moving upwards, opens the "clamp down" limit switch 2BLS and closes the "clamp up" limit switch 2ALS. "Clamp up" control relay 3CR is energized and "clamp down" control relay 4CR is de-energized completing the P.M. 114 cycle. "Pour signal" control relay 15CR is now energized for the start of the P.M. 113 cycle. All other electrical functions remain the same as in preceding P.M. 114 cycle — Step No. 20.

P.M. 113 Cycle

Step No. 2 — Pour Ready Signal

A signal to the autoladle unit to pour metal is now sent. All other electrical functions remain the same as in preceding P.M. 113 cycle — Step No. 1.

P.M. 113 Cycle

Step No 3 — Pour Metal

The autoladle having received a signal to pour in the preceding step, now pours metal to fill the ladle in the transfer device. All other electrical functions remain the same as in preceding P.M. 113 cycle — Step No. 2.

P.M. 113 Cycle

Step No. 4 — Pour Lock-Out

The autoladle having completed pouring metal to the transfer device ladle now sends a signal to the transfer device which energizes the "autoladle pour lock-out" control relay 16CR. "Pour signal" control relay 15CR is now de-energized. The "clamp up" control relay 3CR is also de-energized and the "abort timer" TD1 is now started. The "clamp up solenoid" is de-energized unlocking the transfer device ladle from the fill position. All other electrical functions remain the same as in preceding P.M. 113 cycle — Step No. 3.

P.M. 113 Cycle

Step No. 5 — Clamp Down

In unclamping the ladle, "clamp up" limit switch 2ALS is opened and the "clamp down" limit switch 2BLS is closed. The "clamp down" control relay 4CR is now energized. The "autoladle pour lock out" control relay 36CR is also energized. All other electrical functions remain the same as in preceding P.M. 113 cycle — Step No. 4.

P.M. 113 Cycle

Step No. 6 — Transfer Device Moving Counter-clockwise

"Fill Position" control relay 2CR is now de-energized. The "counter-clockwise rotation solenoid" on the transfer device is now energized causing the transfer device to start moving from the fill position to the P.M. 113 position, opening "transfer device in fill position" control switch limit switch 1LS. All other electrical functions remain the same as in preceding P.M. 113 cycle — Step No. 5.

P.M. 113 Cycle

Step No. 7 — Transfer Device at P.M. 113 Position

In moving the transfer device closes "transfer device at P.M. 113 position" limit switch 8LS. The "fast approach solenoid" is now energized. "Transfer device at P.M. 113 position" control relay 37CR is also energized. In FIG. 13, a signal is sent to P.M. 113 that the transfer device is at the P.M. 113 position. All other electrical functions remain the same as in preceding P.M. 113 cycle — Step No. 6.

P.M. 113 Cycle

Step No. 8 — Transfer Device in P.M. 113 Position

In rotating into the P.M. 113 position, the "transfer device in P.M. 113 position" limit switch 4LS is now closed. "Transfer device in P.M. 113 position" control relay 6CR is now energized and the "fast approach solenoid" is now de-energized. Meanwhile in FIG. 14, a signal is received from P.M. 114 that de-energizes "cooling cycle timer" control relay 31CR. All other electrical functions remain the same as in preceding P.M. 113 cycle — Step No. 7.

P.M. 113 Cycle

Step No. 9 — Ladle Down

The "ladle up" control relay 41CR is now de-energized and the "ladle down" control relay 42CR is now energized. The "Ladle up solenoid" is de-energized and the "ladle down solenoid" is energized. The ladle now moves down from the up position and the "ladle up" limit switch 11BLS is now opened. "Ladle timer on" timer TD2 is now started. Meanwhile in FIG. 14, a signal received from P.M. 114 indicates that the molds are now opening and the "mold halves closed" control relay 29CR is now de-energized. All other electrical functions remain the same as in preceding P.M. 113 cycle — Step No. 8.

P.M. 113 Cycle

Step No. 10 — Ladle Fully Down

The closing of "ladle down" limit switch 11ALS indicates that the ladle has now dropped into the fully down position for pouring. The "ladle down" control relay 40CR is now energized. Meanwhile in FIG. 14, a signal received from P.M. 114 indicates that the unloader has left the discharge position to remove the castings poured in the P.M. 114 cycle and this signal causes the "unloader over discharge" control relay 28CR to be de-energized. All other electrical functions remain the same as in preceding P.M. 113 cycle — Step No. 9.

P.M. 113 Cycle

Step No. 11 — Ladle Motor Turned

"Ladle motor drive on" control relay 39CR is now energized. The ladle motor starts turning causing the molds on PM 113 to be poured with the metal contained in the ladle. "Fast speed timer on" timer TD3 is now energized. All other electrical functions remain the same as in preceding P.M. 113 cycle — Step No. 10.

P.M. 113 Cycle

Step No. 12 — Ladle Motor Turning

In turning, the ladle leaves its horizontal position and the "ladle horizontal" limit switch 3LS is now opened. Opening of the limit switch results in "ladle horizontal" control relay 5CR being de-energized as is the "autoladle pour lock-out" control relay 36CR. The "abort timer on" timer TD1 is now also de-energized. In FIG. 14, an incoming signal from P.M. 114 results in the energizing of "unloader over discharge" control relay 28CR. All other electrical functions remain the same as in preceding P.M. 113 cycle — Step No. 11.

P.M. 113 Cycle

Step No. 13 — Ladle Vertical

The ladle in turning has now poured the castings on P.M. 113 and reaches a vertical position and closes the contact on "ladle vertical" limit switch 6LS. "Ladle vertical" control relay 8CR is now energized. The "ladle return to horizontal position" control relay 10CR is now energized and "P.M. 113 selector" control relay 13CR is now de-energized and since the pouring of P.M. 113 has now been completed, the "autoladle pour lock-out" control relay 16CR is now de-energized, making it possible for the transfer device to be refilled when it reaches the "fill" position later in the cycle. In FIG. 12, the P.M. 113 machine now goes into its cooling cycle, the molds having been poured. P.M. 113 issues a signal and "cooling cycle timer" control relay 25CR is now energized. The transfer device at this stage issues a signal to P.M. 113 to start the timer. The signal that has been going out to P.M. 113 to keep the molds closed is now cancelled. Meanwhile, in FIG. 14, P.M. 114 issues a signal to the transfer device that the loader is over the pick-up and de-energizes "loader over pick-up" control relay 30CR. The "loader down" control relay 32CR is now also energized. All other electrical functions remain the same as in preceding P.M. 113 cycle — Step No. 12.

P.M. 113 Cycle

Step No. 14 — Ladle Return to Horizontal — P.M. 114 Pour Signal Lock

As the ladle motor continues to turn, the "ladle vertical" limit switch 6LS is now re-opened. This causes the "ladle vertical" control relay 8CR to de-energize. In FIG. 13 the outgoing signal to start the timer in P.M. 113 is discontinued. The "P.M. 114 pour signal lock-in" control relay 12CR is now energized and the P.M. 113 pour signal lock-in control relay 11CR is de-energized. All other electrical functions remain the same as in preceding P.M. 113 cycle — Step No. 13.

P.M. 113 Cycle

Step No. 15 — Ladle Horizontal — P.M. 114 Selector

"Ladle Horizontal" limit switch 3LS is now closed as the ladle turns into the horizontal position. This results in the energizing of "ladle horizontal" control relay 5CR and the de-energizing of "ladle motor drive on" control relay 39CR. "Ladle timer" TD2 and "fast speed" timer TD3 as well as "ladle return to horizontal position" control relay 10CR are de-energized. "The ladle down solenoid" is now de-energized and the "ladle up" solenoid is energized causing the ladle to rise from the pouring position. The "P.M. 114 selector" control relay 14CR is now energized indicating that the transfer device will next service P.M. 114. In FIG. 14, an incoming signal energizes the "loader over pick-up" control relay 30CR, de-energizes "loader down" control relay 32CR and a signal is sent to P.M. 114 to close the molds. All other electrical functions remain the same as in preceding P.M. 113 cycle — Step No. 14.

P.M. 113 Cycle

Step No. 16 — Ladle Up

The ladle moving into the up position closes the "ladle up" limit switch 11BLS and opens the "ladle down" limit switch 11ALS. The "ladle down" control relay 40CR and 42CR are now de-energized while the "ladle up" control relay 41CR is now energized. The counter-clockwise solenoid is now de-energized so that the transfer device ceases to be driven in a counter-clockwise direction holding it in the P.M. 113 pouring position. All other electrical functions remain the same as in preceding P.M. 113 cycle — Step No. 15.

P.M. 113 Cycle

Step No. 17 — Transfer Device Return to Fill Position

The clockwise rotation solenoid is now energized causing the transfer device to return to the fill position from P.M. 113. Meanwhile in FIG. 14, a signal coming in from P.M. 114 energizes "mold halves closed" control relay 29CR. All other electrical functions as in preceding P.M. 113 cycle — Step No. 16.

P.M. 113 Cycle

Step No. 18 — Transfer Device Returning to Fill Position

The transfer device in returning to the fill position opened the "transfer device in P.M. 113 position" limit switch 4LS and de-energizes the "transfer device in P.M. 113 position" control relay 6CR. All other electrical functions remain the same as in preceding P.M. 113 cycle — Step No. 17.

P.M. 113 Cycle

Step No. 19 — Transfer Device Returning to Fill Position

"Transfer device at P.M. 113 position" limit switch 8LS is now opened and the "transfer device at P.M. 113 position" control relay 37CR is now de-energized. The "fast approach solenoid" is now energized. In FIG. 12 the signal being sent to P.M. 113 that the transfer device is at the P.M. 113 position is cancelled. All other electrical functions remain the same as in preceding P.M. 113 cycle — Step No. 18.

P.M. 113 Cycle

Step No. 20 — Transfer Device in Fill Position

The "transfer device in fill position" limit switch 1LS is now closed signifying the arrival of the transfer device to the fill position. The corresponding "fill position" control relay 2CR is now energized. The "clockwise rotation" and the "fast approach" solenoids are de-energized with the return of the transfer device from the P.M. 113 position so that rotational drive of the transfer device is discontinued and the "clamp up solenoid" is energized so that the transfer device is firmly clamped in the fill position. All other electrical functions remain the same as in preceding P.M. 113 cycle — Step No. 19.

P.M. 113 Cycle

Step No. 21 — Clamp Up — P.M. 114 Cycle. Step No. 1 — Pour Ready

In clamping the transfer device in the fill position the "clamp down" limit switch 2BLS is opened and the "clamp up" limit switch 2ALS is closed. The "clamp down" control relay 4CR is now de-energized while the "clamp-up" control relay 3CR is now energized.

Thus, P.M. 113 cycle ends and the start of the next P.M. 114 cycle occurs in this step by the energizing of the "pour signal" control relay 15CR. The system will now continue through a P.M. 114 cycle from Steps 1 to 21 as shown in FIG. 14 and on reaching Step No. 21, will be back at Step No. 1 of P.M. 113 cycle. The system will continue to go through P.M. 113 cycles and P.M. 114 cycles alternately producing pistons in a completely automatic manner.

Having described the invention, what is claimed is:

1. An automatic pouring apparatus for charging a mold with molten metal comprising:

a ladle assembly including a pouring ladle, and ladle support means operatively supporting the ladle for rotational movement between a substantially horizontal normal attitude for filling it with molten metal and a tilted attitude for pouring the metal from the ladle, and rotating cam means operatively contacting the ladle assembly for rotating the ladle in a controlled manner to the pouring attitude to pour the metal from the ladle at a controlled pour rate, and the ladle support means includes a member connected to the ladle, the member being rotatable about a horizontal axis and laterally movable between at least two spaced positions, in one of which the ladle is positioned for filling and in the other positioned for being tilted to the pouring attitude, and the cam means operatively contacts the member for rotating it, whereby both the position and the attitude of the ladle are operatively controlled for effecting filling and pouring of a molten charge in a predetermined sequential operation to effect pouring at a controlled rate.

2. An automatic pouring apparatus for charging a mold with molten metal comprising:

a ladle assembly including a pouring ladle, and ladle support means operatively supporting the ladle for rotational movement between a substantially horizontal normal attitude for filling it with molten metal and a tilted attitude for pouring the metal from the ladle, and rotating cam means operatively contacting the ladle assembly for rotating the ladle in a controlled manner to the pouring attitude to pour the metal from the ladle at a controlled pour rate, and the ladle support means includes a member connected to the ladle, the member being rotatable about a horizontal axis and laterally movable between at least two spaced positions, in one of which the ladle is positioned for filling and in the other positioned for being tilted to the pouring attitude, and the cam means operatively contacts the member for rotating it, whereby both the position and the attitude of the ladle are operatively controlled for effecting filling and pouring of a molten charge in a predetermined sequential operation to effect pouring at a controlled rate, and the cam means includes a cam follower, the follower being fixedly connected to the member for rotating it, a rotary cam body supported and positioned relative to the cam follower to move it and impart the rotational movement to the member when the cam body is rotated, and means for rotating the cam body.

3. An automatic pouring apparatus for charging a mold with molten metal comprising:

a ladle assembly including a pouring ladle, and ladle support means operatively supporting the ladle for rotational movement between a substantially horizontal normal attitude for filling it with molten metal and a tilted attitude for pouring the metal from the ladle, and rotating cam means operatively contacting the ladle assembly for rotating the ladle in a controlled manner to the pouring attitude to pour the metal from the ladle at a controlled pour rate, and including means for raising and lowering the ladle.

4. Automatic metal pouring apparatus comprising:

swinging arm means including support means a horizontally extending arm carried at one end thereof by support means, the arm being mounted so as to be rotatable about its longitudinal axis and radially movable about the support means in an arcuate sweeping fashion:

a pouring ladle carried at the other end of the arm and rotatable therewith whereby the arm may, by rotation about its longitudinal axis, move the ladle from a substantially horizontal attitude through a tilting motion by a pouring attitude;

arm rotating means for rotating the arm about its longitudinal axis, the rotating means being carried by the support means in contact with the support end of the arm, and comprising:

a cam and cam follower combination for effecting rotation of the arm and means for operating the combination, and means pivotally attaching the arms to the support means for movement about the support means between at least two positions, namely a fill position and a pour position.

5. The apparatus of claim 4 including means for raising and lowering the vertical height of the ladle.

6. The apparatus of claim 4 wherein:

the cam follower is fixedly attached to the end of the arm and the cam is rotatably mounted on the support means.

7. The apparatus of claim 6 wherein:

the arm rotating means includes an electric motor and the cam is carried thereby for rotational movement against the cam follower whereby the arm may be rotated to change the attitude of the ladle.

8. The apparatus of claim 4 further including electrical control circuit means for controlling the operation of the apparatus, wherein:

the arm rotating means is electrically operated, the pivotal attaching means is electrically operated, and circuit means includes:

first switch means positioned so as to be actuated when the arm is in the fill and pour positions, electrical circuit means connected between the first switch means and the pivotal attaching means for controlling the radial movement of the arm, second switch means positioned so as to be actuated when the ladle is in the fill and pour attitudes, and electrical circuit means connected between the second switch means and the arm rotating means for controlling the rotation of the arm about its longitudinal axis.

9. The apparatus according to claim 4 including:

molten metal holding and dispensing means positioned relative to the metal pouring apparatus so as to dispense molten metal into the ladle when the ladle is placed in a fill position;

mold means positioned relative to the metal pouring apparatus so as to receive the molten metal when the ladle is placed in a "pour" position and rotated for pouring;

first electrical means for providing an electrical actuation signal when a metered amount of molten metal has been dispensed into the ladle of the pouring apparatus;

second electrical means responsive to said first electrical means signal for actuating the means for moving the arm radially about the support means from the fill position to the pour position which is over the mold means;

third electrical means, responsive to the position of the arm when in the pour position, for providing an electrical signal to initiate rotation of the ladle and pouring of the metal into the mold means;

fourth electrical means associated with the arm rotating means and responsive to the third electrical means signal for actuating the arm rotating means and pouring the metal from the ladle;

fifth electrical means for providing an electrical signal when the ladle has emptied; and sixth electrical means responsive to the fifth electrical means signal for actuating the means for moving the arm radially about the support means from the pour position to the fill position.

10. The apparatus of claim 4 wherein the ladle is carried by the arm in such a manner that upon tilting the ladle rotates about a horizontal axis extending across the tip of the pouring spout.

11. Automatic piston pouring assembly comprising:

metal pouring apparatus including:

support means, a horizontally extending arm supported at one end thereof by the support means, the arm being mounted thereon so as to be rotatable about its longitudinal axis and radially movable about the support means in an arcuate sweeping fashion;

a pouring ladle carried at the other end of the arm and rotatable therewith whereby the arm, by rotation about its longitudinal axis, moves the ladle from a substantially horizontal attitude through a tilting motion to a pouring attitude;

arm rotating means carried by the support means in contact with the support end of the arm, the rotating means including a cam and cam follower combination for effecting rotation of the arm and means for operating the combination, and means for moving the arm radially about the support means between at least two positions, namely a fill position and a pour position;

molten metal holding and dispensing means positioned relative to the pouring apparatus for dispensing molten metal into the ladle thereof when the ladle is placed in the fill position;

piston mold means positioned relative to the metal pouring apparatus for receiving molten metal from the ladle when it is placed in a pour position and rotated for pouring;

electrical control means for controlling the coaction between the pouring apparatus, the holding and dispensing means, and the piston mold means, including:

first electrical means for providing an electrical actuation signal when a metered amount of molten metal has been dispensed into the ladle of the pouring apparatus;

second electrical means responsive to said first electrical means signal for actuating the means for moving the arm radially about the support means from the fill position to the pour position over the piston mold means;

third electrical means, responsive to the position of the arm when in the pour position, for providing an electrical signal to initiate rotation of the ladle and pouring of the metal into the piston mold means;

fourth electrical means, associated with the arm rotating means and responsive to the third electrical means signal for actuating the arm rotating means and pouring the metal from the ladle;

fifth electrical means for providing an electrical signal when the ladle has emptied;

sixth electrical means responsive to the fifth electrical means signal for actuating the means for moving the arm radially about the support means from the pour position back to the fill position;

automatic strut placing means associated with the piston molding means, seventh electrical means associated with the strut placing means for producing a signal when strut placing is completed and initiating dispensing of the molten metal from the holding and dispensing means into the ladle, and means for initiating operation of the electrical control means whereby automatic cycling of the assembly is initiated.

12. Automatic metal pouring apparatus comprising:

swinging arm means including support means a horizontally extending arm carried at one end of the support means, the arm being mounted so as to be rotatable about its longitudinal axis and radially movable about the support means in an arcuate sweeping fashion;

a pouring ladle carried at the other end of the arm and rotatable therewith whereby the arm may, by rotation about its longitudinal axis, move the ladle from a substantially horizontal attitude through a tilting motion to a pouring attitude, arm rotating and control means for rotating the arm about its longitudinal axis in a controlled manner whereby the tilting of the ladle and the rate of pour therefrom is controlled, the rotating means being carried by the support means in contact with the arm, and means pivotally attaching the arm to the support means for radial movement about the support means between at least two positions, namely a fill position and a pour position.

13. An automatic pouring apparatus for charging a mold with molten metal comprising:

a ladle assembly including a pouring ladle, and ladle support means operatively supporting the ladle for rotational movement between a substantially horizontal normal attitude for filling it with molten metal and a tilted attitude for pouring the metal from the ladle, and rotating cam means operatively contacting the ladle assembly for rotating the ladle in a controlled manner to the pouring attitude to pour the metal from the ladle at a controlled pour rate, and the ladle support means is constructed and arranged to support the ladle such that upon tilting the ladle rotates about a horizontal axis extending across the tip of the ladle pouring spout.

14. An automatic ladle for pouring molten metal comprising:

a pouring ladle, a substantially horizontal arm supporting the ladle at one end thereof for rotational movement between a substantially horizontal normal attitude for filling the ladle and a tilted attitude for pouring the metal from the ladle when the arm is rotated about its horizontal axis, and rotating means operatively connected to the arm for tilting it in a controlled manner whereby the pouring rate is controlled, and the ladle supporting arm supports the ladle such that upon tilting the ladle rotates about a horizontal axis extending across the tip of the ladle pouring spout.

15. Automatic metal pouring apparatus comrpising;

swinging arm means including support means a horizontally extending arm carried at one end of the support means, the arm being mounted so as to be rotatable about its longitudinal axis and radially movable about the support means in an arcuate sweeping fashion;

a pouring ladle carried at the other end of the arm and rotatable therewith whereby the arm may, by rotation about its longitudinal axis, move the ladle from a substantially horizontal attitude through a tilting motion to a pouring attitude, arm rotating and control means for rotating the arm about its longitudinal axis in a controlled manner whereby the tilting of the ladle and the rate of pour therefrom is controlled, the rotating means being carried by the support means in contact with the arm, and means pivotally attaching the arm to the support means for radial movement about the support means between at least two positions, namely a fill position and a pour position, and the ladle is carried by the arm such that upon tilting the ladle rotates about a horizontal axis extending across the tip of the ladle pouring spout.

* * * * *